US008888248B2

(12) United States Patent
Hiwada et al.

(10) Patent No.: US 8,888,248 B2
(45) Date of Patent: Nov. 18, 2014

(54) LIQUID DROPLET JETTING APPARATUS

(71) Applicant: Brother Kogyo Kabushiki Kaisha, Aichi-Ken (JP)

(72) Inventors: Shuhei Hiwada, Toyoake (JP); Hiroto Sugahara, Ama (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/760,512

(22) Filed: Feb. 6, 2013

(65) Prior Publication Data

US 2013/0235122 A1 Sep. 12, 2013

(30) Foreign Application Priority Data

Mar. 12, 2012 (JP) ..... 2012-054578

(51) Int. Cl.
*B41J 2/04* (2006.01)
*B41J 2/05* (2006.01)
*B41J 2/14* (2006.01)

(52) U.S. Cl.
CPC ..... *B41J 2/14* (2013.01); *B41J 2202/08* (2013.01); *B41J 2/1408* (2013.01)
USPC ..... 347/54; 347/56

(58) Field of Classification Search
CPC .... B41J 2/1628; B41J 2/14427; B41J 2/1631; B41J 2/1639; B41J 2/1642; B41J 2/1623
USPC ..... 347/54, 56
See application file for complete search history.

(56) References Cited

U.S. PATENT DOCUMENTS

| | | | |
|---|---|---|---|
| 5,631,676 | A | 5/1997 | Karz |
| 6,367,911 | B1 | 4/2002 | Windel et al. |
| 2003/0063449 | A1 | 4/2003 | Suzuki et al. |

(Continued)

FOREIGN PATENT DOCUMENTS

| | | |
|---|---|---|
| EP | 0352726 | 1/1990 |
| JP | 2003-080683 | 3/2003 |

(Continued)

OTHER PUBLICATIONS

Extended European Search Report for Application No. 13154262.3 dated Jun. 18, 2013.

(Continued)

*Primary Examiner* — Lisa M Solomon
(74) *Attorney, Agent, or Firm* — Frommer Lawrence & Haug LLP

(57) ABSTRACT

There is provided a liquid droplet jetting apparatus, including: a liquid droplet jetting head configured to include a liquid droplet jetting surface formed with a plurality of nozzles from which liquid droplets are jetted, an energy applying mechanism configured to apply a jetting energy to a liquid in each of the nozzles, and a driving device configured to drive the energy applying mechanism; a relative movement mechanism configured to relatively move, along the liquid droplet jetting surface, the liquid droplet jetting head and an object to be jetted; and a heat radiating member configured to be provided in the liquid droplet jetting head to radiate heat generated in the driving device. The heat radiating member includes a heat radiating surface which is positioned on a plane including the liquid droplet jetting surface or which projects toward the object as compared with the plane including the liquid droplet jetting surface.

18 Claims, 29 Drawing Sheets

(56) References Cited

U.S. PATENT DOCUMENTS

| | | | | |
|---|---|---|---|---|
| 2005/0062799 | A1 | 3/2005 | Kitahara et al. | |
| 2006/0061634 | A1 | 3/2006 | Hori | |
| 2006/0139391 | A1* | 6/2006 | Kubo | 347/18 |
| 2006/0139419 | A1 | 6/2006 | Shigemura | |
| 2006/0170732 | A1 | 8/2006 | Yamada | |
| 2006/0250451 | A1 | 11/2006 | Suzuki et al. | |
| 2011/0074886 | A1 | 3/2011 | Kubo | |

FOREIGN PATENT DOCUMENTS

| | | |
|---|---|---|
| JP | 2006-116949 | 5/2006 |
| JP | 2006-181949 | 7/2006 |
| JP | 2006-205689 | 8/2006 |
| JP | 2007-320278 | 12/2007 |
| JP | 2009-214510 | 9/2009 |
| JP | 2011-073244 | 4/2011 |
| WO | WO 99/62715 | 12/1999 |
| WO | WO 03/080345 | 10/2003 |
| WO | WO 2005/082629 | 9/2005 |

OTHER PUBLICATIONS

Chinese Office Action for Application No. 201310077777.3 dated Aug. 5, 1014.

* cited by examiner

LIQUID DROPLET JETTING APPARATUS

CROSS REFERENCE TO RELATED APPLICATION

The present application claims priority from Japanese Patent Application No. 2012-054578 filed on Mar. 12, 2012, the disclosure of which is incorporated herein by reference in its entirety.

BACKGROUND OF TILE INVENTION

1. Field of the Invention

The present invention relates to a liquid droplet jetting apparatus which jets liquid droplets.

2. Description of the Related Art

Japanese Patent Application laid-open No. 2011-73244 discloses an ink-jet printer which jets droplets of ink onto a recording medium from nozzles of an ink-jet head to record an image and the like. The ink-jet head includes a channel unit in which an ink channel including a plurality of nozzles is formed and a piezoelectric actuator which applies pressure to the ink in each of the nozzles. A lower surface of the channel unit is a liquid droplet jetting surface on which the plurality of nozzles are open. The piezoelectric actuator is disposed at an upper surface of the channel unit which is a surface opposite to the liquid droplet jetting surface.

A COF board on which a driver IC (driving device) is mounted is connected to the upper surface of the piezoelectric actuator. The COF board is bent upward at a connection portion connected to the piezoelectric actuator and is connected to a control hoard via a FPC board. The driver IC supplies a driving signal to the piezoelectric actuator via a wiring line formed in the COF board. The driver IC is provided at a tip portion of the COF board and is positioned above the piezoelectric actuator by bending the COF board upward. Further, a flat plate-shaped heat sink (heat radiating member) formed of a metallic material is provided above the driver IC. The heat sink makes contact with the upper surface of the driver IC to radiate heat generated in the driver IC at the time of driving the piezoelectric actuator.

SUMMARY OF THE INVENTION

In a case that the heat generated in the driver IC (driving device) is not radiated sufficiently by the heat sink, a temperature of the driver IC increases. Therefore, in some cases, it is required that the ink-jet head is stopped or suspended temporarily during the use of the printer to prevent breakage of the driver IC due to overheating. Accordingly, it is desired that the heat sink having high heat-radiation efficiency is adopted so that the heat generated in the driver IC can be radiated reliably.

An object of the present invention is to provide a liquid droplet jetting apparatus which is capable of promoting radiation of heat generated in a driving device effectively.

The liquid droplet jetting apparatus of the first invention is characterized by including: a liquid droplet jetting head configured to include a liquid droplet jetting surface formed with a plurality of nozzles from which liquid droplets are jetted, an energy applying mechanism configured to apply a jetting energy to a liquid in each of the nozzles, and a driving device configured to drive the energy applying mechanism; a relative movement mechanism configured to move, along the liquid droplet jetting surface, the liquid droplet jetting head relative to the object to which the liquid droplets are jetted from the nozzles; and a heat radiating member configured to be provided in the liquid droplet jetting head to radiate heat generated in the driving device, wherein the heat radiating member includes a heat radiating surface which is positioned on a plane including the liquid droplet jetting surface or which is positioned at a downstream side in a jetting direction in which the droplets jetted from the nozzles fly as compared with the plane including the liquid droplet jetting surface.

In a case that the liquid droplet jetting head and the object are relatively moved along the liquid droplet jetting surface, a strong atmospheric current or air flow is generated between the liquid droplet jetting surface and the object. In the present invention, the heat radiating surface of the heat radiating member is positioned on the plane including the liquid droplet jetting surface or projects toward the object to be arranged as compared with the plane including the liquid droplet jetting surface. Therefore, heat radiation from the heat radiating surface is promoted due to the atmospheric current, and thereby enhancing heat-radiation efficiency of the heat radiating member.

DESCRIPTION OF THE PREFERRED EMBODIMENTS

[First Embodiment]

Figure 1:
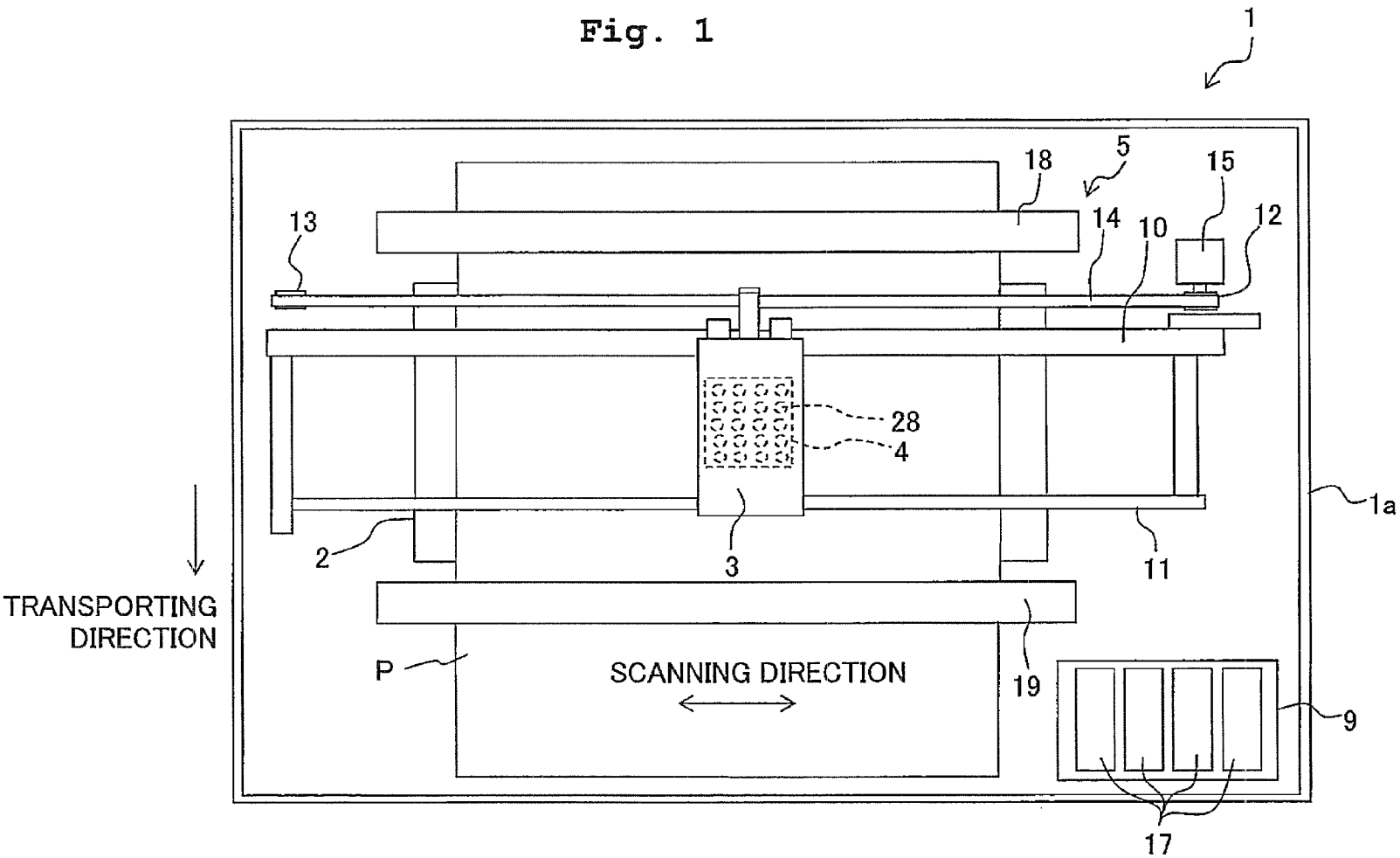
FIG. 1 is a schematic plan view of an ink-jet printer according to the first embodiment.

Next, an explanation will be made about the first embodiment of the present invention. At first, an explanation will be made about a schematic construction of an ink-jet printer 1 with reference to FIG. 1. Hereinbelow, the frontward side of the paper surface of FIG. 1 is defined as an upward direction and the rearward side of the paper surface of FIG. 1 is defined as a downward direction. Then, an explanation will be made by appropriately using words indicating directions such as "up" and "down".

The ink-jet printer 1 of the first embodiment as shown in FIG. 1 is a so-called serial type printer in which an ink-jet head 4 mounted on a carriage 3 reciprocates in a scanning direction with respect to a recording paper sheet P. As shown in FIG. 1, the ink-jet printer 1 includes a platen 2, the carriage 3, the ink-jet head 4, a transport mechanism 5, etc.

The recording paper sheet P (corresponding to an object to be jetted of the present invention) is placed on the upper surface of the platen 2. Further, two guide rails 10, 11 extending parallel to a left-right direction (scanning direction) of FIG. 1 are provided above the platen 2. The carriage 3 is configured to be reciprocatively movable in the scanning direction along the two guide rails 10, 11 in an area facing the platen 2. Further, an endless belt 14 wound and applied between two pulleys 12, 13 is connected to the carriage 3. When the endless belt 14 is driven to travel by a carriage driving motor 15, the carriage 3 is reciprocatively moved in the scanning direction in accordance with the travel of the endless belt 14.

The ink-jet head 4 is attached to the carriage 3 and is reciprocatively moved in the scanning direction together with the carriage 3. A plurality of nozzles 28 are formed in the lower surface (a surface on the rearward side of the paper surface of FIG. 1) of the ink-jet head 4. The ink is jetted onto the recording paper sheet P positioned at the lower side of the ink-jet head 4 from each of the nozzles 28 formed at the lower surface of the ink-jet head 4. Further, as shown in FIG. 1, a holder 9 is provided in a printer body 1*a* of the printer 1. Four ink cartridges 17 which respectively store four colors of inks including black, yellow, cyan, and magenta are installed to the holder 9. Although illustrations are omitted, the holder 9 is connected to the ink-jet head 4 mounted on the carriage 3 via four tubes (not shown). Accordingly, the four colors of inks stored in the four ink cartridges 17 are respectively supplied to the ink-jet head 4 via the four tubes. The ink-jet head 4 jets the four colors of inks from the nozzles 28 onto the recording paper sheet P placed on the platen 2.

The transport mechanism 5 (corresponds to a transport mechanism of the present invention) includes two transport rollers 18, 19 arranged to interpose the platen 2 in a transport direction. The two transport rollers 18, 19 are driven to be rotated in synchronization by an unillustrated motor. The transport mechanism 5 transports the recording paper sheet P placed on the platen 2 in the transport direction by the two transport rollers 18, 19.

The ink-jet printer 1 jets the ink onto the recording paper sheet P from the ink-jet head 4 while moving the carriage 3 in the scanning direction with respect to the recording paper sheet P placed on the platen 2. With this, the recording paper sheet P is transported in the transport direction by the two transport rollers 18, 19. In accordance with the operation as described above, an image, characters, and the like are recorded on the recording paper sheet P. In the first embodiment, the carriage driving motor 15 shown in FIG. 1 which moves the carriage 3 on which the ink-jet head 4 is mounted in the scanning direction corresponds to a "relative movement mechanism" of the present invention which relatively moves the ink-jet head 4 and the recording paper sheet P.

Figure 2:
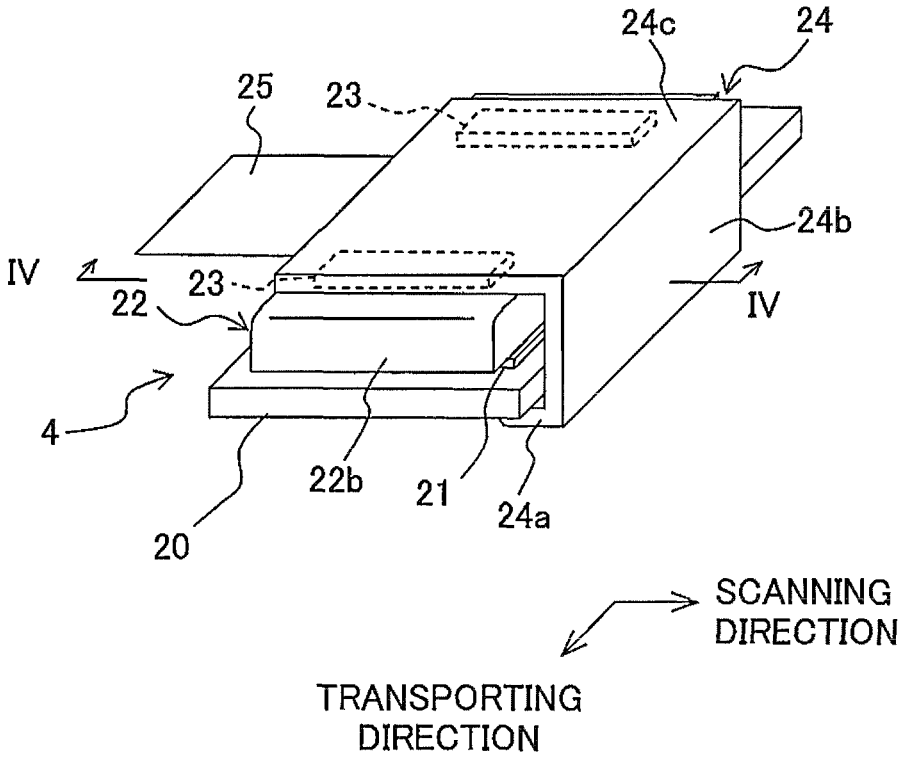
FIG. 2 is a perspective view of an ink-jet head and a heat radiating member.
Figure 3:
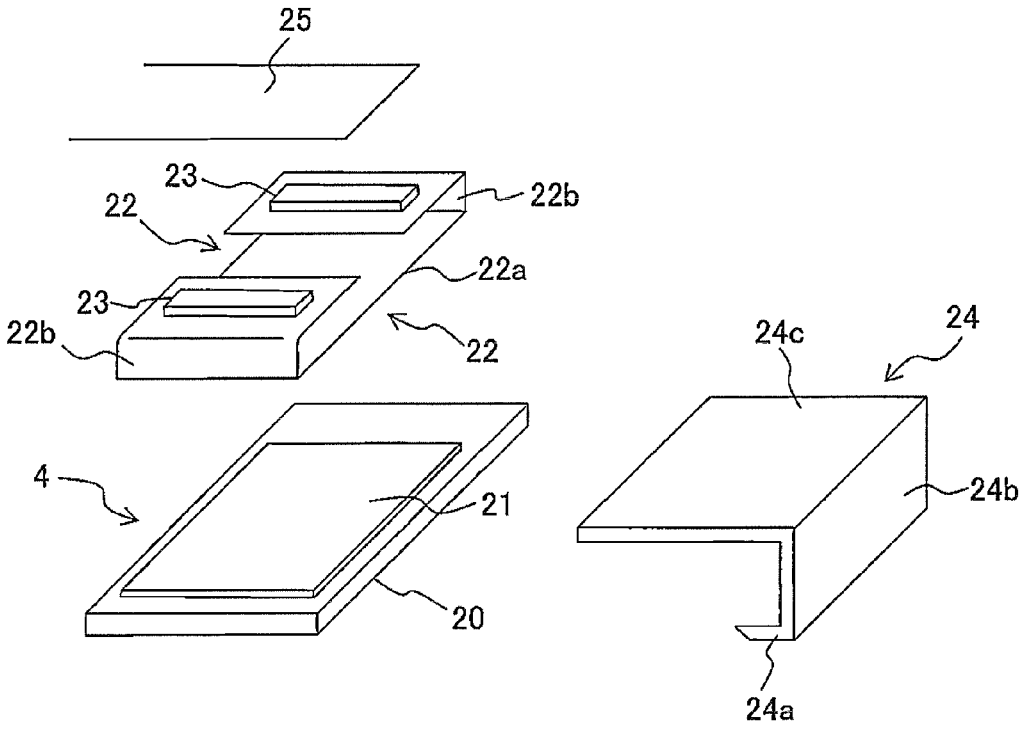
FIG. 3 is an exploded perspective view of the ink-jet head and the heat radiating member.
Figure 4:
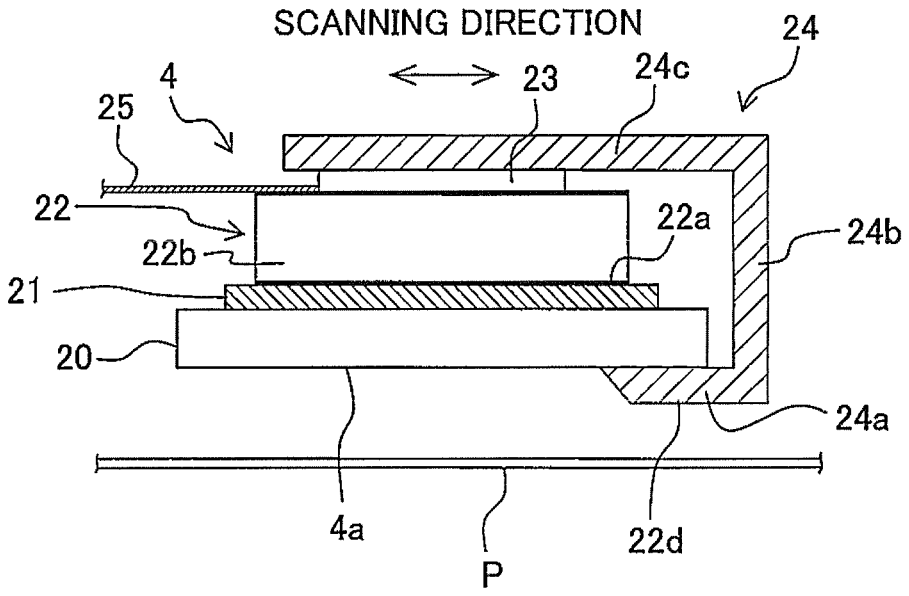
FIG. 4 is a cross-sectional view in relation to the vertical plane including the line VI-VI to illustrate the ink-jet head and the heat radiating member in FIG. 2.

Next, an explanation will be made about the ink-jet head 4. As shown in FIGS. 2 to 4, the ink-jet head 4 includes a channel unit 20, a piezoelectric actuator 21 (energy applying mechanism) disposed on the upper surface of the channel unit 20, a COF 22 (Chip On Film) connected to the upper surface of the piezoelectric actuator 21, and two driver ICs 23 (driving devices) mounted on the COF 22. As will be explained in detail Eater, the heat radiating member 24 to radiate the heat generated in each driver IC 23 is provided in the ink-jet head 4.

Figure 5:
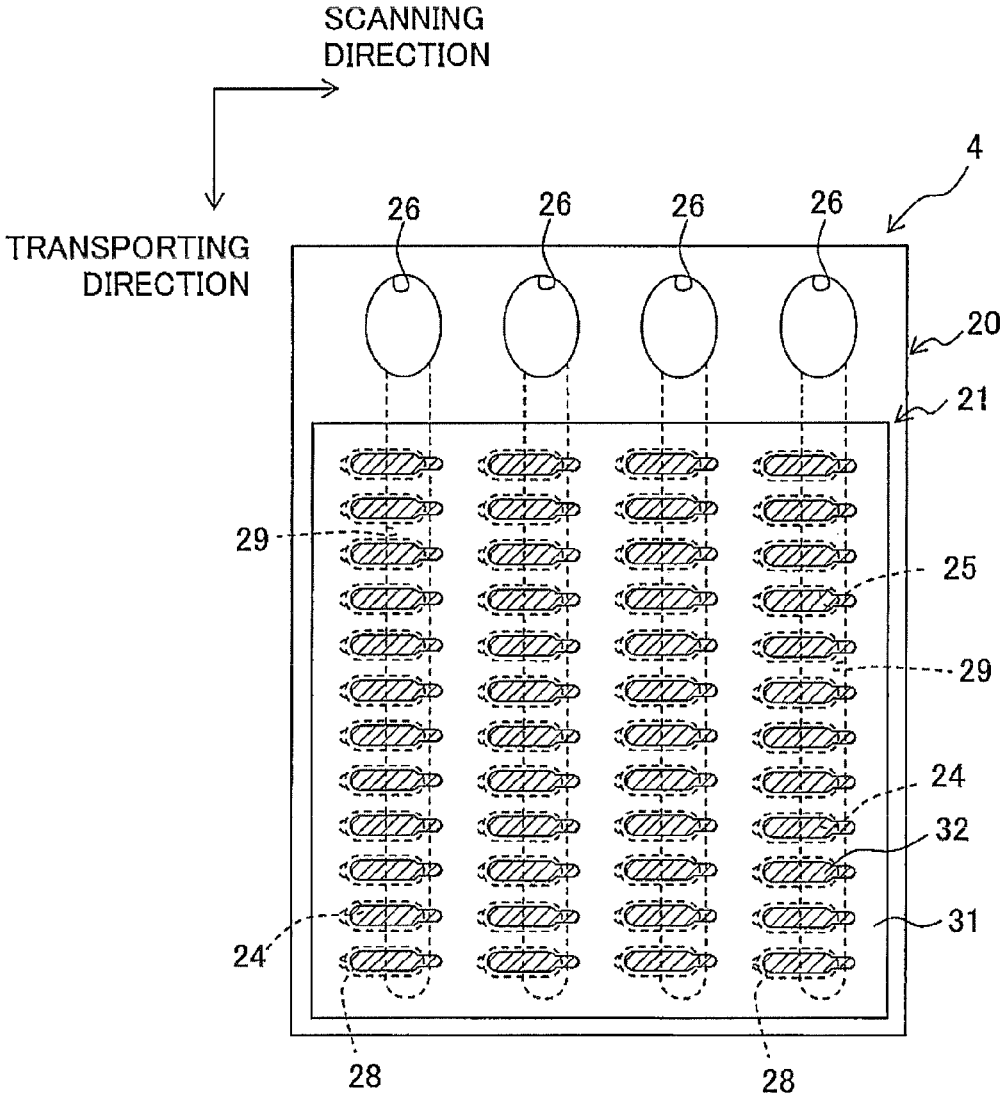
FIG. 5 is a plan view of a channel unit and a piezoelectric actuator of the ink-jet head.
Figure 6A:
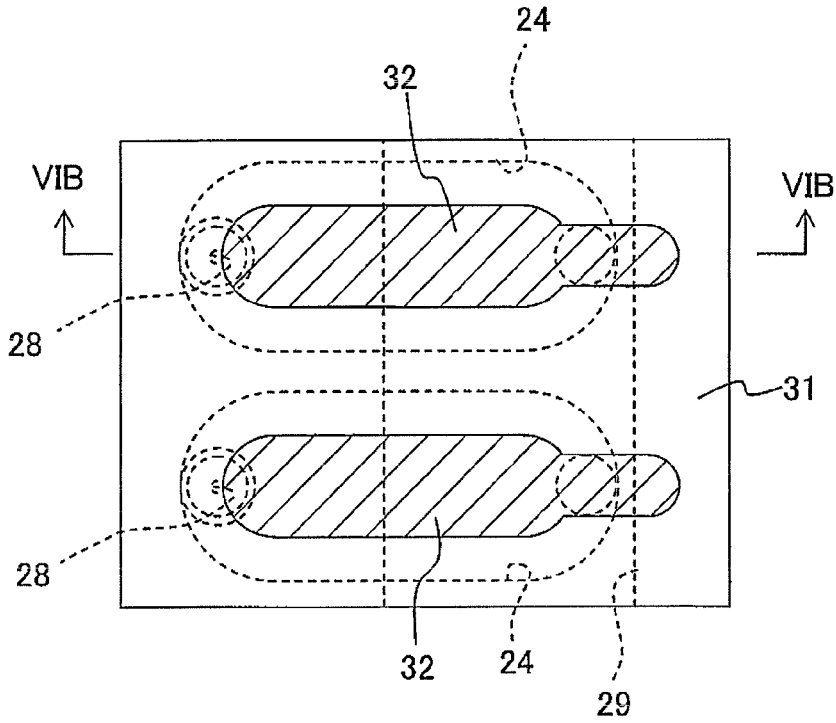
FIG. 6A is a partially enlarged view of FIG. 5.
Figure 6B:
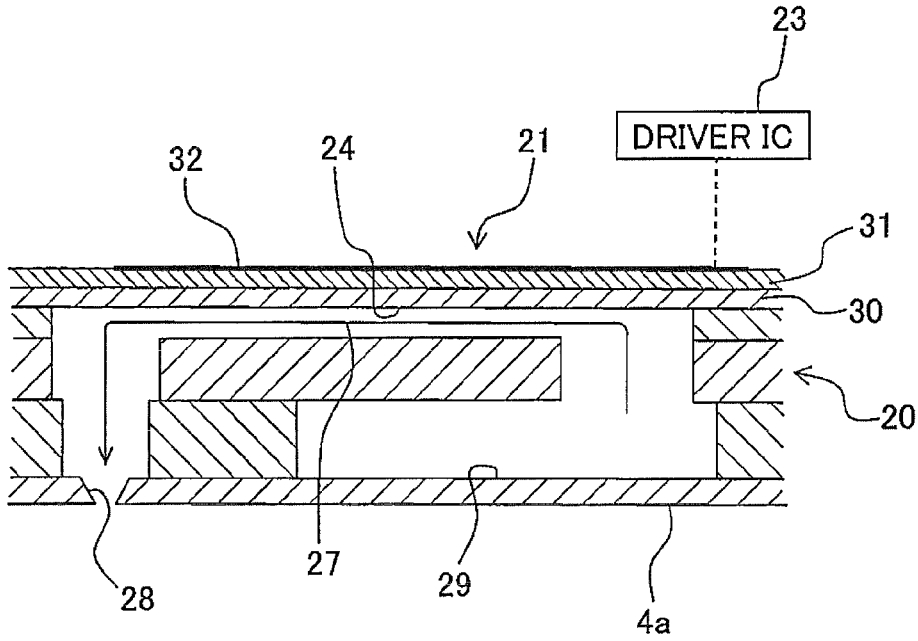
FIG. 6B is a cross-sectional view taken along the line VIB-VIB in FIG. 6A.

As shown in FIG. 6B, the channel unit 20 has a structure in which four plates are stacked. As shown in FIG. 5, four ink supply holes 26 are formed to be aligned in the scanning direction on the upper surface of the channel unit 20. The four ink supply holes 26 are respectively connected to the ink cartridges 17 (see FIG. 1) of the four colors (black, yellow, cyan, and magenta). Further, the channel unit 20 includes four manifolds 29 each extending in the transport direction therein. The four manifolds 29 are communicated with the four ink supply holes 26, respectively. Accordingly, the four colors of inks are supplied to the four manifolds 29, respectively.

The plurality of nozzles 28 are formed in the lower surface of the channel unit 20. That is, a liquid droplet jetting surface 4*a* on which the plurality of nozzles 28 are open is provided on the lower surface of the channel unit 20. Although illustrations are omitted, the liquid droplet jetting surface 4*a* is covered with a liquid repellent film formed of a resin material having a high liquid repellent property such as fluororesin in order to prevent the ink adhered to the liquid droplet jetting surface 4*a* from staying around the openings of the nozzles 28. A plurality of pressure chambers 24 communicated with the plurality of nozzles 28 respectively are formed on the upper surface of the channel unit 20.

As shown in FIG. 5, four arrays of the nozzles 28 are aligned corresponding to the four manifolds 29, respectively as viewed in a plan view. Four arrays of the pressure chambers 24 are aligned as well corresponding to the four manifolds 29 in the same manner as the nozzles 28. The pressure chambers 24 are covered from thereabove with the piezoelectric actuator 21, as will be described later, disposed on the upper surface of the channel unit 20. As shown in FIG. 6B, each of the pressure chambers 24 is communicated with the corresponding manifold 29. Accordingly, a plurality of individual ink channels 27 each branching from the manifold 29 via one of the pressure chambers 24 to arrive at one of the nozzles 28 are formed in the channel unit 20.

As shown in FIG. 5 and FIG. 6, the piezoelectric actuator 21 includes a vibration plate 30 which covers the pressure chambers 24, a piezoelectric layer 31 arranged on the upper surface of the vibration plate 30, and a plurality of individual electrodes 32 corresponding to the plurality of pressure chambers 24 respectively. The vibration plate 30 is formed of a metallic material and is connected to a ground wire of each driver IC 23 to be kept at a ground electric potential all the time. Accordingly, the vibration 30 functions as a common electrode facing the plurality of individual electrodes 32 sandwiching the piezoelectric layer 31. The piezoelectric layer 31 is polarized in a direction of thickness thereof at portions sandwiched between the vibration plate 30 and the individual electrodes 32.

As shown in FIG. 2 to FIG. 4, the COF 22 is disposed above the piezoelectric actuator 21. The COF 22 includes a connection portion 22*a* connected to the individual electrodes 32 disposed on the upper surface of the piezoelectric layer 31 and two extending portions 22*b*, which extend from the connection portion 22*a* toward an upstream side and a downstream side in the transport direction, respectively. Further, as shown in FIG. 3, each of the two extending potions 22*b* is bent upward and end portions of the two extending portions 22*b* are allowed to approach each other, and thereby the COF 22 is formed in a circular manner (ring shape) as whole. The ring shape of the COF 22 is held by a holding member (not shown) arranged inside of the COF 22.

Two driver ICs 23 are mounted at the end portions of the two extending portions 22*h* of the COF 22, respectively. By bending the two extending portions 22*h* upward, the two driver ICs 23 are arranged above the piezoelectric actuator 21. Further, each of the driver ICs 23 is provided at the upper surface of the end portion of one of the extending portions 22*b*, that is, at a surface on the side opposite to the piezoelectric actuator 21. The two driver ICs 23 are connected to the individual electrodes 32 via a plurality of wirings (not shown) formed in the COF 22. It is not indispensable to provide the two driver ICs 23, and the number of driver IC(s) 23 to be provided may be appropriately changed depending on the number of output terminals included in one driver IC 23, the number of individual electrodes 32 to which a signal is outputted, and the like.

The end portions of the two extending portions 22*b* on which the two driver ICs 23 are respectively mounted are connected to a Flexible Printer Circuit (FPC) 25. The FPC 25 is connected to an unillustrated control board which controls each of the components or sections of the printer 1 including the ink-jet head 4. The control board and the two driver ICs 23 are connected by the FPC 25 and a control signal transmitted from the control board is inputted to the two driver ICs 23. The two driver ICs 23 output a driving signal having a predetermined waveform to the individual electrodes 32 corresponding to the nozzles 28 through which the liquid droplets are jetted based on the control signal inputted from the control board.

The operation of the piezoelectric actuator 21 at the time of jetting the ink from the nozzles 28 is as follows. That is, in a case that the driving signal is applied from each driver IC 23 to one individual electrode 32, a potential difference occurs between the one individual electrode 32 disposed on the upper side of the piezoelectric layer 31 and the vibration plate 30 as the common electrode disposed on the lower side of the piezoelectric layer 31 kept at the ground potential. Then, the electric field in the thickness direction acts in a portion, of the piezoelectric layer 31, sandwiched between the one individual electrode 32 and the vibration plate 30. In this situation, since the polarization direction and a direction of the electric field in the piezoelectric layer 31 are parallel with each other, the piezoelectric layer 31 extends or elongates in the thickness direction which is the polarization direction thereof and contracts in a planar direction. When the piezoelectric layer 31 is deformed to contract, a portion of the vibration plate 30 facing the pressure chamber 24 is bent to form a projection toward the pressure chamber 24 (unimorph deformation). At this time, since a volume of the pressure chamber 24 is decreased, pressure (jetting energy) is applied to the ink at the interior of the pressure chamber 24, and droplets of ink are jetted from the nozzle 28 communicated with the pressure chamber 24.

Next, an explanation will be made about the heat radiating member 24. The heat radiating member 24 is formed of a material having a high thermal conductivity such as a metal. As shown in FIG. 2 to FIG. 4, the heat radiating member 24 includes a first heat-radiating portion 24*a*, a second heat-radiating portion 24*b*, and a third heat-radiating portion 24*c*. The first heat-radiating portion 24*a*, the second heat-radiating portion 24*b*, and the third heat-radiating portion 24*c* are formed integrally with one another to have a structure coupled to one another. Although illustrations are omitted in FIG. 2 to FIG. 4, the heat radiating member 24 is attached to the carriage 3 (see FIG. 1) in the same manner as the ink-jet head 4, and the heat radiating member 24 reciprocates integrally with the ink-jet head 4 in the scanning direction.

The first heat-radiating portion 24*a* is positioned at the lower side of one end portion (right end portion of FIG. 4) of the channel unit 20 in the scanning direction and extends along the liquid droplet jetting surface 4*a* in a horizontal direction. A lower surface (heat radiating surface 24*d*) of the first heat-radiating portion 24*a* is a surface facing the recording paper sheet P, and the heat radiating surface 24*d* projects downwardly as compared with the plane including the liquid droplet jetting surface 4*a*. Noted that, as a matter of course, the first heat-radiating portion 24*a* is arranged to cover an area, of the lower surface of the channel unit 20, other than the liquid droplet jetting surface 4*a* in which the nozzles 28 are formed.

As shown in FIG. 4, the second heat-radiating portion 24*b* extends upward from the end portion of the first heat-radiating portion 24*a* (namely, a side opposite to the heat radiating surface 24*d* facing the recording paper sheet P) at a side of the ink-jet head 4 (right side in FIG. 4). Although the second heat-radiating portion 24*h* extends from the first heat-radiating portion 24*a* in a direction perpendicular to the liquid droplet jetting surface 4*a* (upward in the vertical direction) in FIG. 4, the second heat-radiating portion 24*b* may extend upward along a direction which is inclined with respect to the vertical direction to some extent.

The third heat-radiating portion 24*c* is disposed above the ink-jet head 4 (a side opposite to the liquid droplet jetting surface 4*a*) to extend from the upper end portion of the second heat-radiating portion 24*b* in the horizontal direction. In FIG. 4, the third heat-radiating portion 24*c* makes contact with the two driver ICs 23 positioned above the piezoelectric actuator 21. The third heat-radiating portion 24*c* preferably makes contact directly with the driver ICs 23 so as to effectively remove the heat of the driver ICs 23 as described above, but the third heat-radiating portion 24*c* may make contact with the driver ICs 23 via another member. In this case, however, the material having the high thermal conductivity is preferably used as the member interposed between the third heat-radiating portion 24*c* and the driver ICs 23. For example, in order to enhance adhesion between the third heat-radiating portion 24*c* and the driver ICs 23, a structure, in which the third heat-radiating portion 24*c* and the driver ICs 23 are brought in contact with each other via a paste material containing a conducting particle may be adopted.

In FIG. 4, in a case that the carriage 3 and the ink-jet head 4 are integrally moved in the scanning direction with respect to the recording paper sheet P by the carriage driving motor 15, a strong air flow is generated in a narrow gap between the liquid droplet jetting surface 4*a* of the ink-jet head 4 and the recording paper sheet P. In particular, the narrow gap between the liquid droplet jetting surface 4*a* and the recording paper sheet P is approximately 1 mm in the ink-jet printer, and thus a current velocity of the air flow generated in this gap is very high.

In this regard, the heat radiating member 24 of this embodiment includes the first heat-radiating portion 24*a* extending along the liquid droplet jetting surface 4*a* of the ink-jet head 4, and the heat radiating surface 24*d* of the first heat-radiating portion 24*a* projects downward as compared with the liquid droplet jetting surface 4*a*. Therefore, the strong air flow generated in the gap between the liquid droplet jetting surface 4*a* and the recording paper sheet P flows along the heat radiating surface 24*d*. Accordingly, the heat radiation from the heat radiating surface 24*d* of the first heat-radiating portion 24*a* is promoted, and thereby enhancing the heat-radiating efficiency of the heat radiating member 24.

The heat radiating member 24 includes the second heat-radiating portion positioned at the side of the ink-jet head 4 and the third heat-radiating portion 24*c* positioned above the ink-jet head 4 in addition to the first heat-radiating portion 24*a*. As shown in FIG. 2 and FIG. 4, the heat radiating member 24 is disposed to surround the ink-jet head 4 by the first heat-radiating portion 24*a*, the second heat-radiating portion 24*b*, and the third heat-radiating portion 24*c*. Since a surface area (heat radiation area) of the heat radiating member 24 is larger by including the second heat-radiating portion 24*b* and the third heat-radiating portion 24*c* as described above, an amount of heat radiated from the heat radiating member 24 is increased.

As shown in FIG. 4, the second heat-radiating portion 24*b* is positioned at the right side of the ink-jet head 4. In a case that the ink-jet head 4 moves rightward in FIG. 4, the second heat-radiating portion 24*b* is positioned at a downstream side in a movement direction of the ink-jet head 4. In other words, it is also assumed that the second heat-radiating portion 24*b* is positioned at an upstream side of the liquid droplet jetting surface 4*a* of the ink-jet head 4 in a direction in which the recording paper sheet P is relatively moved toward the ink-jet head 4. In this situation, the strong air flow generated when the recording paper sheet P is relatively moved toward the ink-jet head 4 hits the second heat-radiating portion 24*b*. That is, from a viewpoint of promoting the heat radiation from the heat radiating member 24, the number of times the carriage 3 moves rightward in FIG. 4 during recording on the recording paper sheet P is preferably greater than the number of times the carriage 3 moves leftward.

An ordinary ink-jet printer is capable of selectively executing two printing (recording) operations including a so-called one-way printing in which jetting of the ink-jet head 4 is performed only when the carriage 3 is moved to one direction in the scanning direction and a so-called two-way printing in which the jetting of the ink-jet head 4 is performed when the carriage 3 is moved to both two directions in the scanning direction. In such an ink-jet printer, when the second heat-radiating portion 24*b* is provided on the downstream side of the ink-jet head 4 in the movement direction of the carriage 3 at the time of performing the one-way printing, in particular, when the one-way printing is selected, the heat generated in each driver IC 23 can be radiated from the second heat-radiating portion 24*b* efficiently. For example, in the construction in FIG. 4, in a case that the one-way printing is selected, the liquid droplets are jetted from the ink-jet head 4 only when the ink-jet head 4 moves rightward in FIG. 4.

The heat radiating surface 24*d* formed in the first heat-radiating portion 24*a* of the heat radiating member 24 projects downward (the side of recording paper sheet P) as compared with the liquid droplet jetting surface 4*a*, and thereby suppressing that the recording paper sheet P makes contact with the liquid droplet jetting surface 4*a* even when warpage and/or bending (curling) is/are caused in the recording paper sheet P. An amount of projection of the heat radiating surface 24*d* is, in particular, preferably less than 1 mm, and more preferably not more than 0.6 mm.

Next, modified embodiments in which various modifications are made in the first embodiment will be described below. The same reference numerals are assigned to components each having the same structure as the first embodiment, and the description of such components is appropriately omitted.

[First Modified Embodiment]

Figure 7:
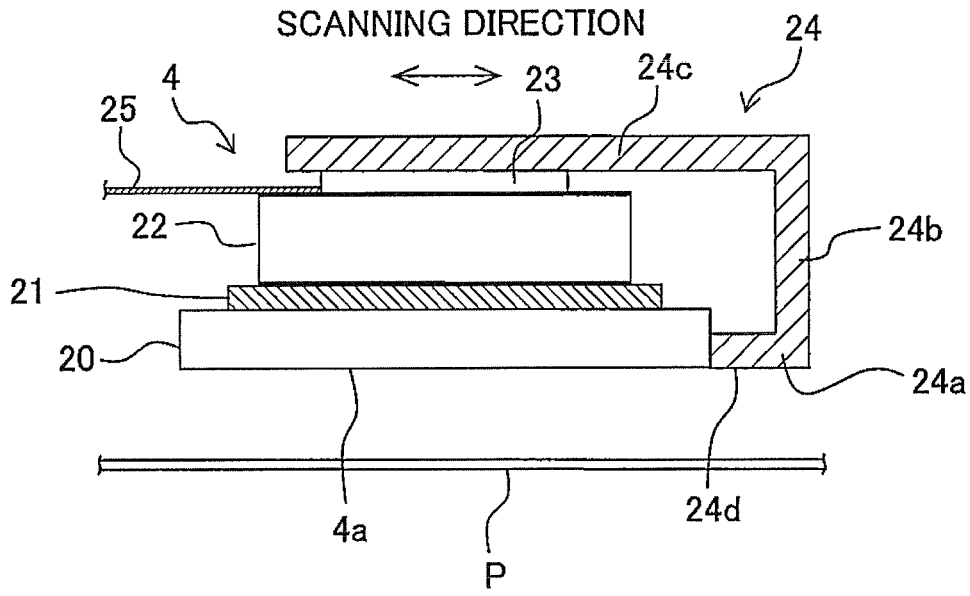
FIG. 7 is a vertical cross-sectional view of the ink-jet head and the heat radiating member in the first modified embodiment of the first embodiment.

In the first embodiment, although the heat radiating surface 24*d* of the first heat-radiating portion 24*a* projects toward the recording paper sheet P as compared with the liquid droplet jetting surface 4*a* of the ink-jet head 4, as shown in FIG. 7, the liquid droplet jetting surface 4*a* and the heat radiating surface 24*d* may be arranged on the same plane.

[Second Modified Embodiment]

Figure 8:
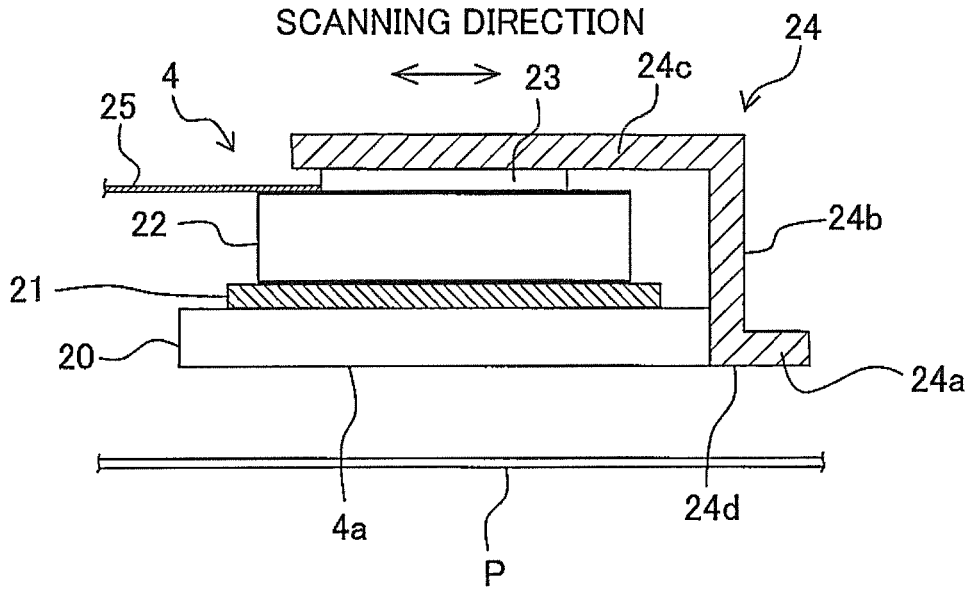
FIG. 8 is a vertical cross-sectional view of the ink-jet head and the heat radiating member in the second modified embodiment of the first embodiment.

As shown in FIG. 8, the first heat-radiating portion 24*a* may extend in an outer side of the liquid jetting surface 4*a* (in a direction opposite to the liquid jetting surface 4*a*) with respect to the second heat-radiating portion 24*h*.

[Third Modified Embodiment]

Figure 9:
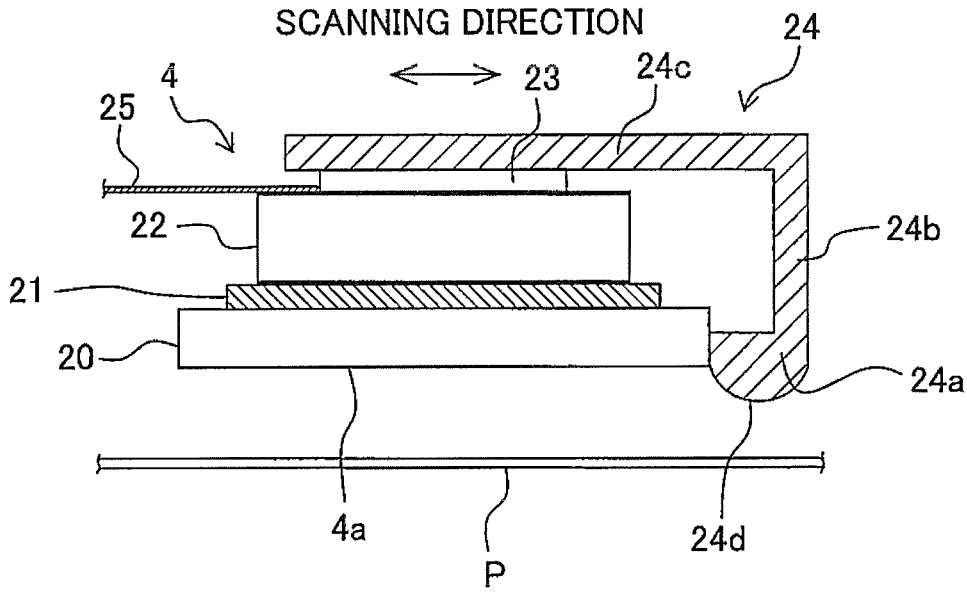
FIG. 9 is a vertical cross-sectional view of the ink-jet head and the heat radiating member in the third modified embodiment of the first embodiment.

It is not indispensable that the heat radiating surface 24*d* of the first heat-radiating portion 24*a* is a surface along the liquid droplet jetting surface 4*a*. The air flow generated between the liquid droplet jetting surface 4*a* and the recording paper sheet P acts on the heat radiating surface 24*d* only by providing the heat radiating surface 24*d* to project downward as compared with the liquid droplet jetting surface 4*a*, and thereby enhancing the heat-radiation efficiency of the heat radiating member 24. For example, as shown in FIG. 9, the heat radiating surface 24*d* of the first heat-radiating portion 24*a* may be a surface having a circular-arc shaped cross-section to project downward as compared with the liquid droplet jetting surface 4*a*.

[Fourth Modified Embodiment]

Figure 10:
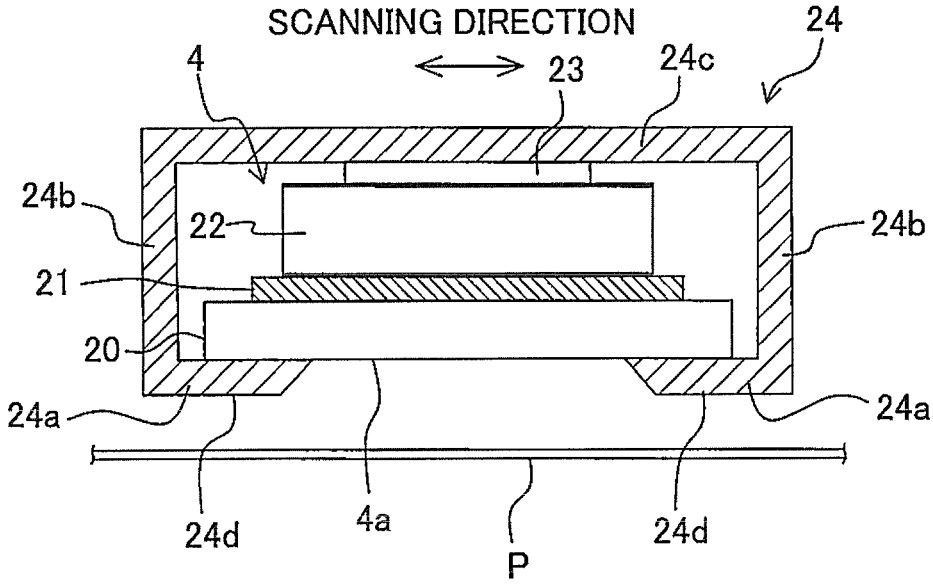
FIG. 10 is a vertical cross-sectional view of the ink-jet head and the heat radiating member in the fourth modified embodiment of the first embodiment.

As shown in FIG. 10, the heat radiating member 24 may include two second heat-radiating portions 24*b* which are disposed on opposite sides in the scanning direction with respect to the liquid droplet jetting surface 4*a* of the ink-jet head 4. In this construction, the heat radiation from the two second heat-radiating portions 24*b* is promoted even when the ink-jet head 4 is moved in any direction of the scanning direction. In FIG. 10, the heat radiating member 24 also includes two first heat-radiating portions 24*a* on opposite sides in the scanning direction with respect to the liquid droplet jetting surface 4*a*. The heat radiating surfaces 24*d* of the two first heat-radiating portions 24*a* project downward as compared with the liquid droplet jetting surface 4*a*, respectively. In this construction, even when the warpage and/or the bending is/are caused in the recording paper sheet P, the two projecting first heat-radiating portions 24*a* disposed to sandwich the liquid droplet jetting surface 4*a* in the scanning direction prevent the recording paper sheet P from being brought in contact with the liquid droplet jetting surface 4*a*.

[Fifth Modified Embodiment]

Figure 11:
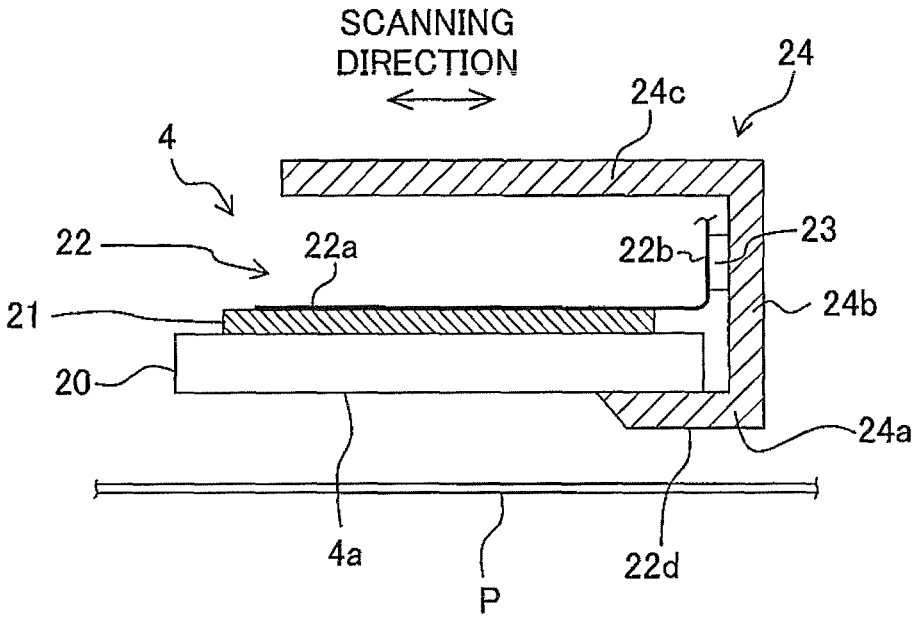
FIG. 11 is a vertical cross-sectional view of the ink-jet head and the heat radiating member in the fifth modified embodiment of the first embodiment.

In the first embodiment, each driver IC 23 makes contact with the third heat-radiating portion 24*c* positioned at the side opposite to the liquid droplet jetting surface 4*a* (upper side on the liquid droplet jetting surface 4*a*) with respect to the ink-jet head 4. However, another construction is also allowable, in which the second heat-radiating portion 24*b* positioned at the side of the ink-jet head 4 makes contact with each driver IC 23. For example, in FIG. 11, the COF 22 is pulled out or drawn from the upper surface of the piezoelectric actuator 21 to one side in the scanning direction (right direction in FIG. 11), and then is bent upward. Each of the driver ICs 23 is mounted on the extending portion 22*b*, of the COF 22, which extends in an up-down direction. Accordingly, each of the driver ICs 23 makes contact with the second heat-radiating portion 24*b*.

[Sixth Modified Embodiment]

Figure 12:
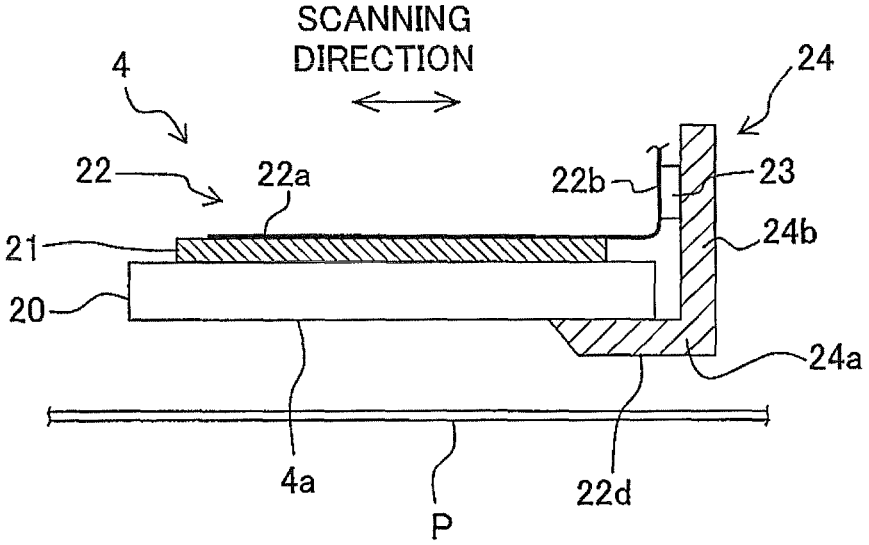
FIG. 12 is a vertical cross-sectional view of the ink-jet head and the heat radiating member in the sixth modified embodiment of the first embodiment.

As shown in FIG. 12, still another construction is also allowable, in which the third heat-radiating portion 24*c* disposed above the ink-jet head 4 is omitted and the heat radiating member 24 has a L-shape formed of the first heat-radiating portion 24*a* and the second heat-radiating portion 24*b*.

[Seventh Modified Embodiment]

Figure 13:
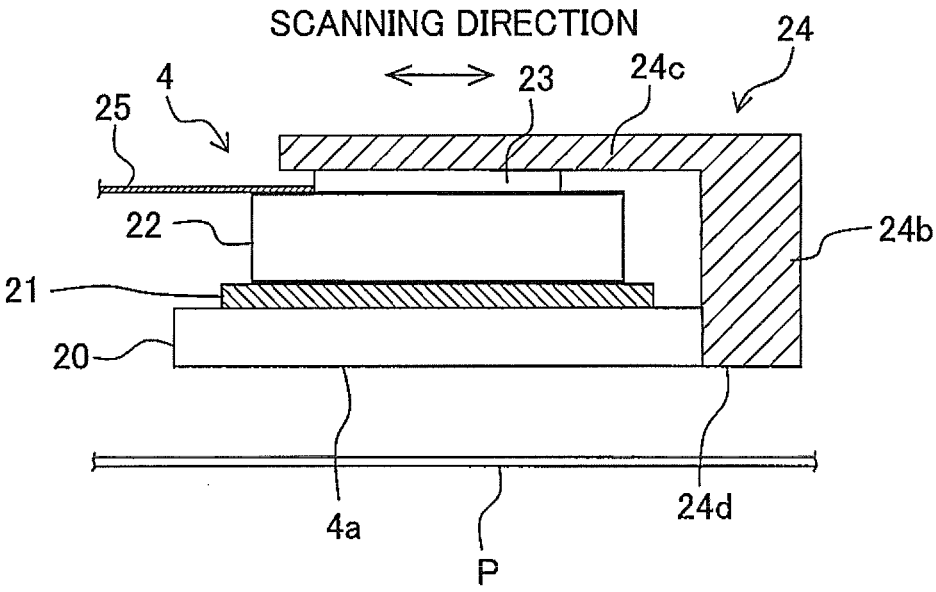
FIG. 13 is a vertical cross-sectional view of the ink-jet head and the heat radiating member in the seventh modified embodiment of the first embodiment.

As shown in FIG. 13, yet another construction is also allowable, in which the first heat-radiating portion 24*a* is omitted and the heat radiating member 24 includes the second heat-radiating portion 24*b* and the third heat-radiating portion 24*c*. In this embodiment, a lower surface of the second heat-radiating portion 24*b* is the heat radiating surface 24*d* which is positioned on the same plane as the liquid droplet jetting surface 4*a* or projects downward as compared with the liquid droplet jetting surface 4*a*. However, in the seventh modified embodiment, a width of the second heat-radiating portion 24*b* in the scanning direction is preferably large to some extent so that the heat radiating surface 24*d* has an area which is not less than a certain size.

[Eighth Modified Embodiment]

Figure 14:
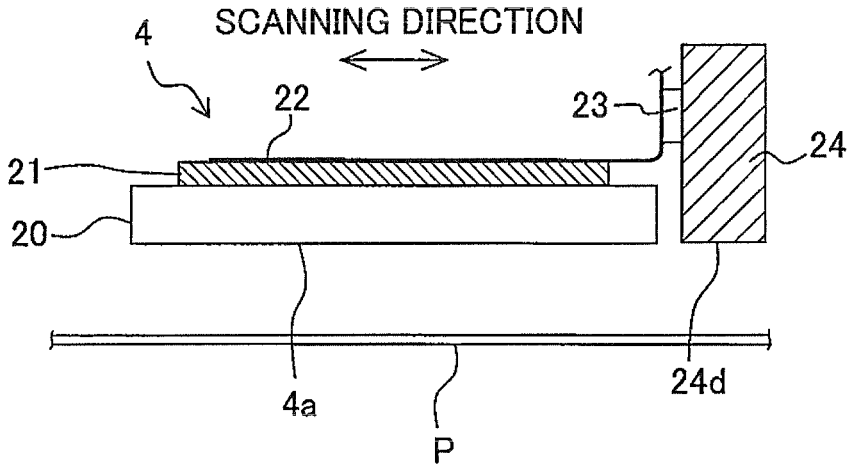
FIG. 14 is a vertical cross-sectional view of the ink-jet head and the heat radiating member in the eighth modified embodiment of the first embodiment.

It is not indispensable for the heat radiating member 24 to have the shape to surround the ink-jet head 4 (FIG. 4 etc.) or the L-shaped cross-section (FIG. 12, FIG. 13) in the present invention. For example, as shown in FIG. 14, it is allowable that the heat radiating member 24 in a rectangular parallelepiped shape is just arranged next to the ink-jet head 4 in the left-right direction (scanning direction). Also in this case, as shown in FIG. 14, by adopting the construction in which the lower surface of the heat radiating member 24 (heat radiating surface 24*d*) is positioned on the same plane as the liquid droplet jetting surface 4*a* or projects downward as compared with the liquid droplet jetting surface 4*a*, effects similar to those of the first embodiment or the modified embodiments as described above can be obtained. Also in the eighth modified embodiment, the width of the heat radiating member 24 in the scanning direction is preferably large to some extent so that the heat radiating surface 24*d* has the area which is not less than the certain size as in the seventh modified embodiment shown in FIG. 13.

[Ninth Modified Embodiment]

Although the heat radiating surface 24*d* of the heat radiating member 24 and the liquid droplet jetting surface 4*a* of the ink-jet head 4 are arranged while being aligned in the scanning direction in the first embodiment and the modified embodiments thereof, the liquid droplet jetting surface 4*a* and the heat radiating surface 24*d* may be arranged while being aligned in the transport direction.

[Second Embodiment]

Figure 15:
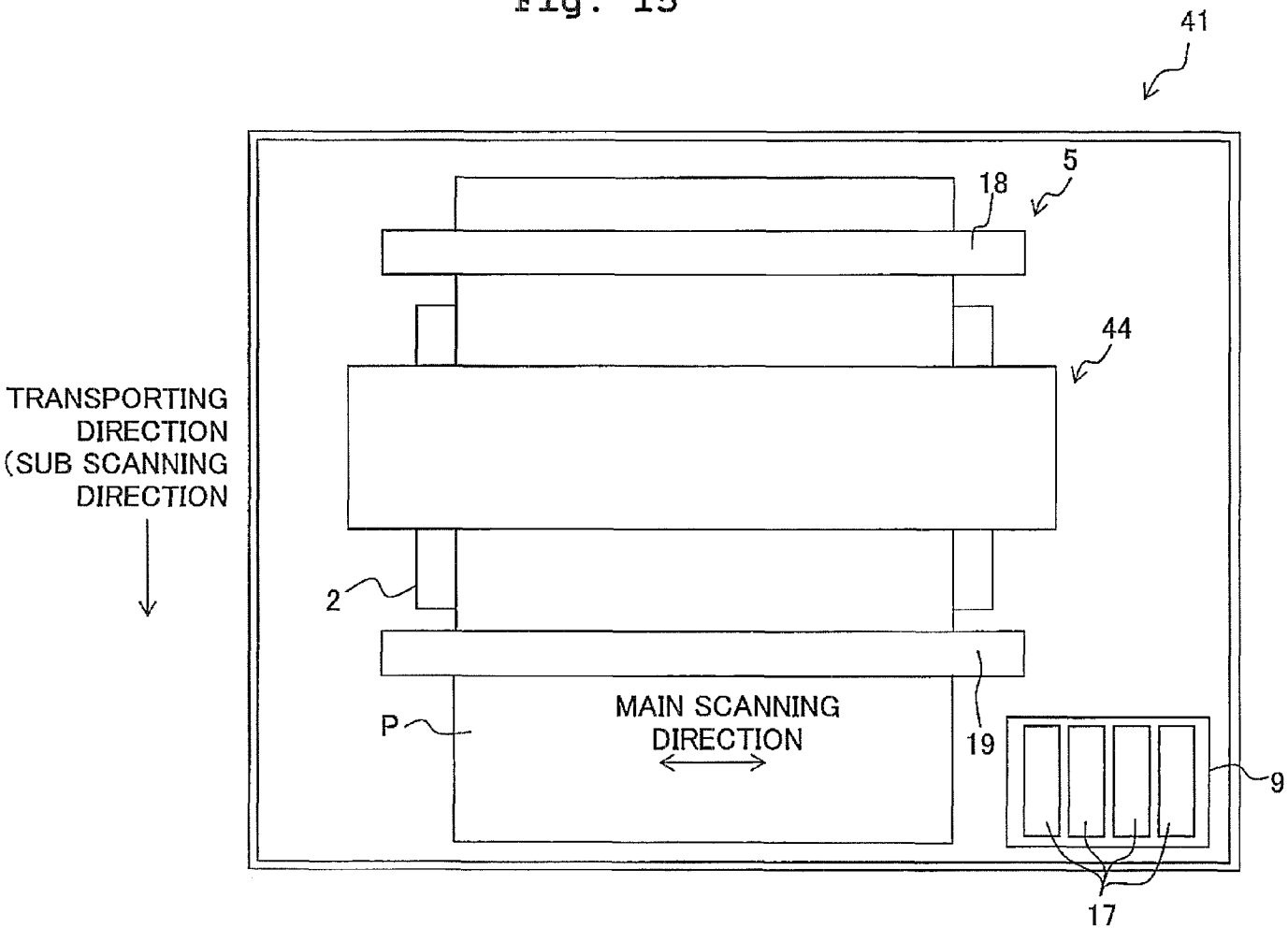
FIG. 15 is a schematic plan view of an ink-jet printer according to the second embodiment.

Next, an explanation will be made about the second embodiment of the present invention. An ink-jet printer 41 of the second embodiment as shown in FIG. 15 includes the platen 2, an ink-jet head 44, the transport mechanism 5, etc. Since the platen 2 and the transport mechanism 5 have constructions which are the same as or equivalent to those of the first embodiment, any explanation of which will be omitted.

The ink-jet head 44 is a so-called a line-type head having a plurality of nozzles which are aligned in a width direction (left-right direction in FIG. 15: hereinbelow, referred to as a main scanning direction) of the recording paper sheet P. The ink-jet head 44 is connected to the holder on which the four colors of the ink cartridges are installed. The ink-jet head 44 jets the liquid droplets of the ink from the nozzles onto the recording paper sheet P which is transported in the transport direction (hereinbelow, referred to also as a secondary scanning direction) of the recording paper sheet P along the platen 2 by the transport mechanism 5. Accordingly, a desired image and the like is recorded on the recording paper sheet P. In the second embodiment, the transport mechanism 5 which transports the recording paper sheet P corresponds to a "relative movement mechanism" of the present invention which relatively moves the ink-jet head 44 and the recording paper sheet P.

Figure 16:
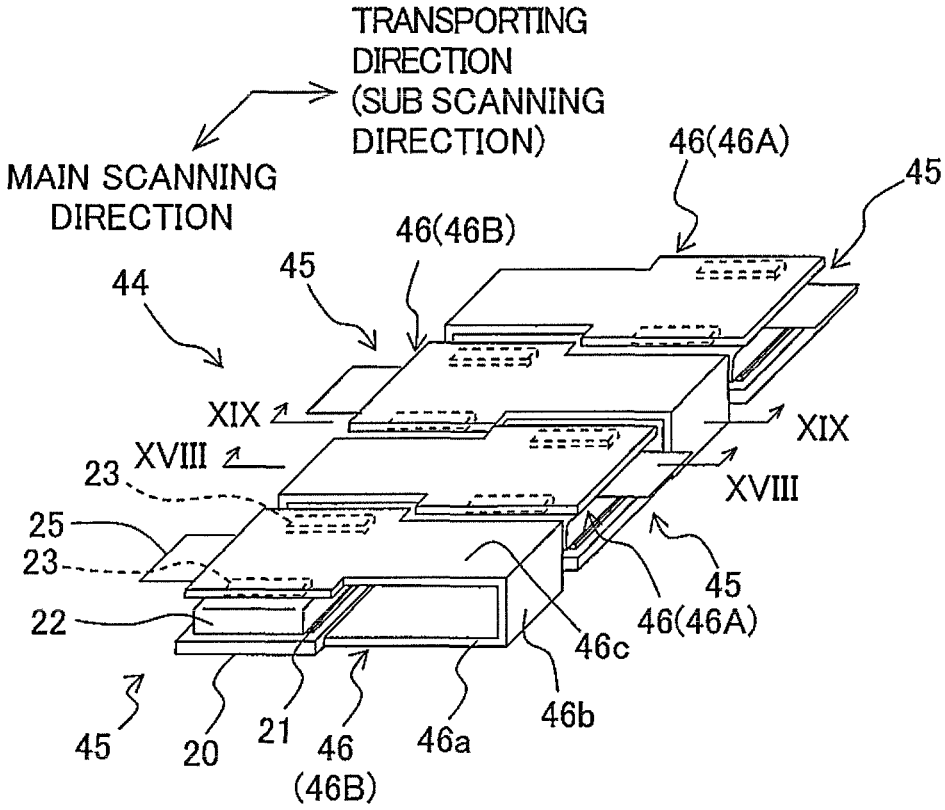
FIG. 16 is a perspective view of an ink-jet head and a heat radiating member according to the second embodiment.

Next, an explanation will be made about the ink-jet head 44. FIG. 16 is a perspective view of the ink-jet head 44 and a heat radiating member 46. As shown in FIG. 16, the ink-jet head 44 includes four jetting units 45. Each of the jetting units 45 has a structure substantially the same as that of the ink-jet head 4 (see FIG. 2 to FIG. 6) of the first embodiment. That is, each of the jetting units 45 includes the channel unit 20, the piezoelectric actuator 21, the COF 22, the driver ICs 23, and the like. That is, one line-type ink-jet head 44 in which the plurality of nozzles are aligned in the main scanning direction is configured such that four jetting units 45, each of which is capable of jetting the ink, are combined with one another. The structures of the channel unit 20, the piezoelectric actuator 21, the COF 22, and the driver ICs 23 of the jetting unit 45 are the same as those in the first embodiment (see FIG. 2 to FIG. 6), and thus any explanation thereof will be omitted.

Figure 17:
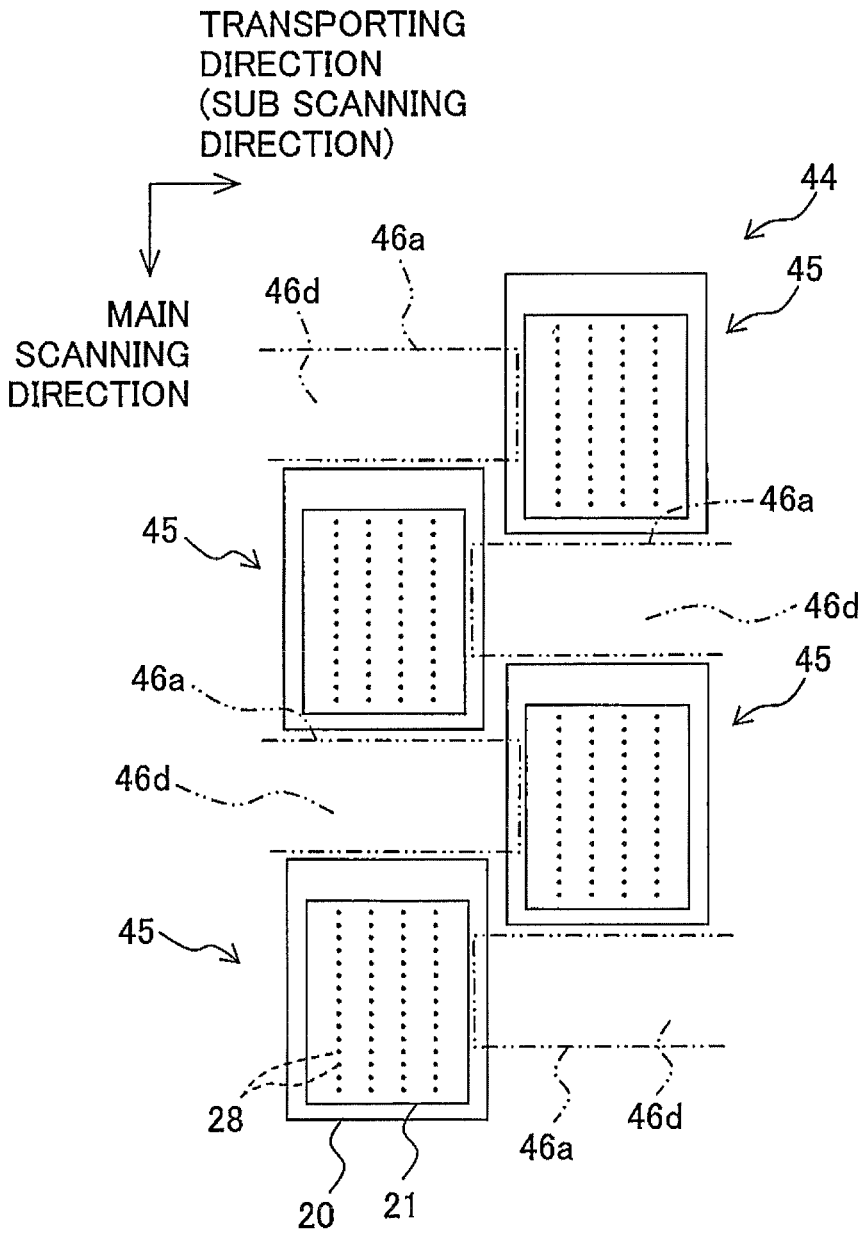
FIG. 17 is a diagram showing a planar arrangement relationship of four jetting units of the ink-jet head.

FIG. 17 is a diagram showing a planar arrangement relationship of the four jetting units 45 of the ink-jet head 44. In FIG. 17, in order to simplify the drawing, only the channel unit 20 and the piezoelectric actuator 21 are shown in each of the jetting units 45, and the illustration of the COF 22 arranged above the piezoelectric actuator 21 is omitted. Further, in FIG. 17, a part of each of the heat radiating members 46 is depicted by two-dot lines.

One jetting unit 45 has the plurality of nozzles 28 arranged in the main scanning direction (first direction). The image is recorded over the entire width of the recording paper sheet P (entire area in the main scanning direction) by the nozzles 28 of the four jetting units 45. Here, when the four jetting units 45 are simply arranged in the main scanning direction, the nozzles 28 of the four jetting units 45 can not be arranged in the main scanning direction at regular intervals, because each interval between the nozzles 28 is increased among the jetting units 45. In view of this, as shown in FIG. 17, the four jetting units 45 are disposed in the main scanning direction (first direction) and are disposed alternately in the secondary scanning direction (second direction). Further, the piezoelectric actuators 21 are arranged to partially overlap with each other, in the main scanning direction, between the adjacent jetting units 45. That is, the four jetting units 45 are disposed in a zigzag form (staggered form).

Figure 18:
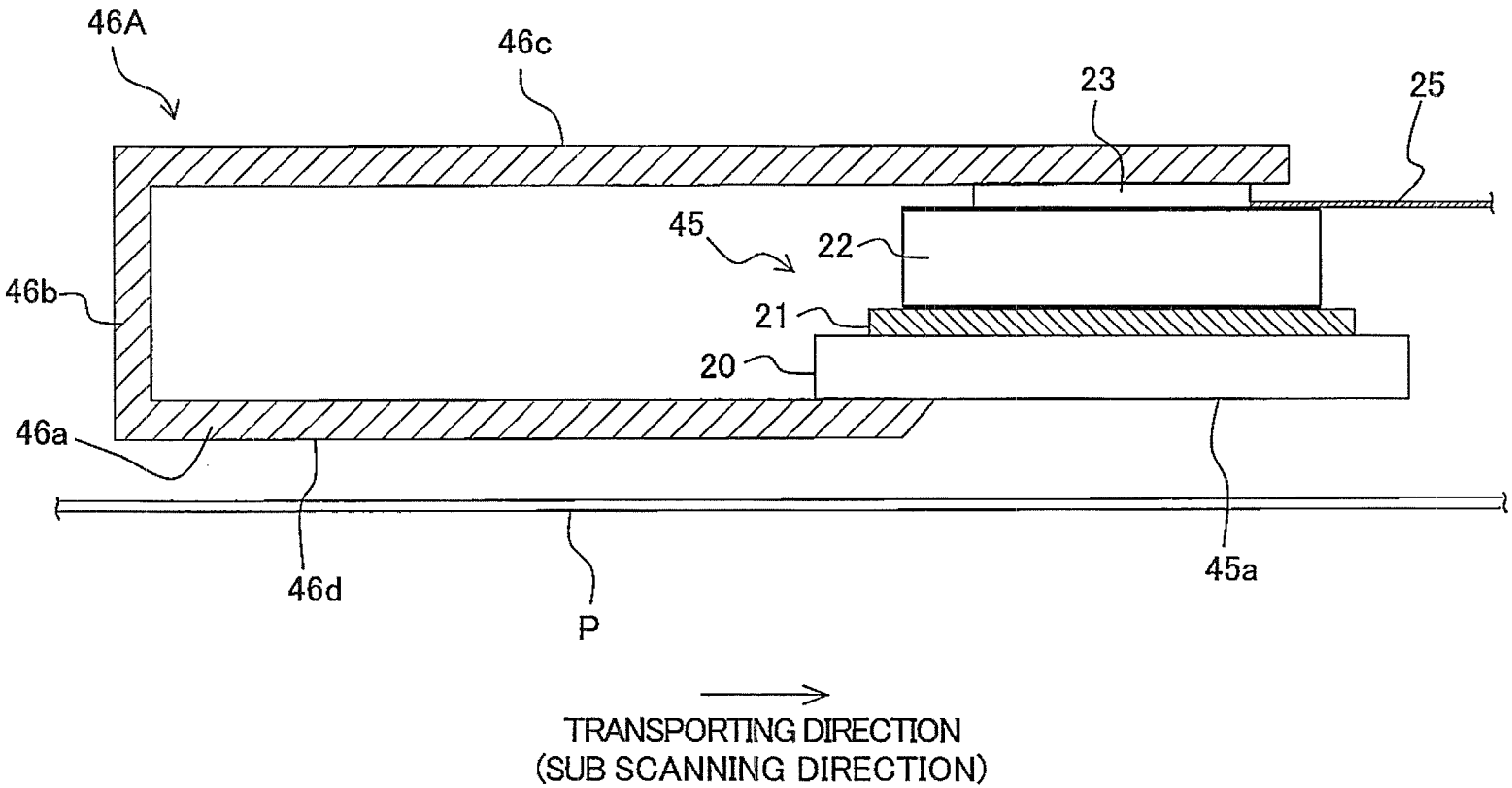
FIG. 18 is a cross-sectional view in relation to the vertical plane including the line XVIII-XVIII to illustrate the ink-jet head and the heat radiating member in FIG. 16.
Figure 19:
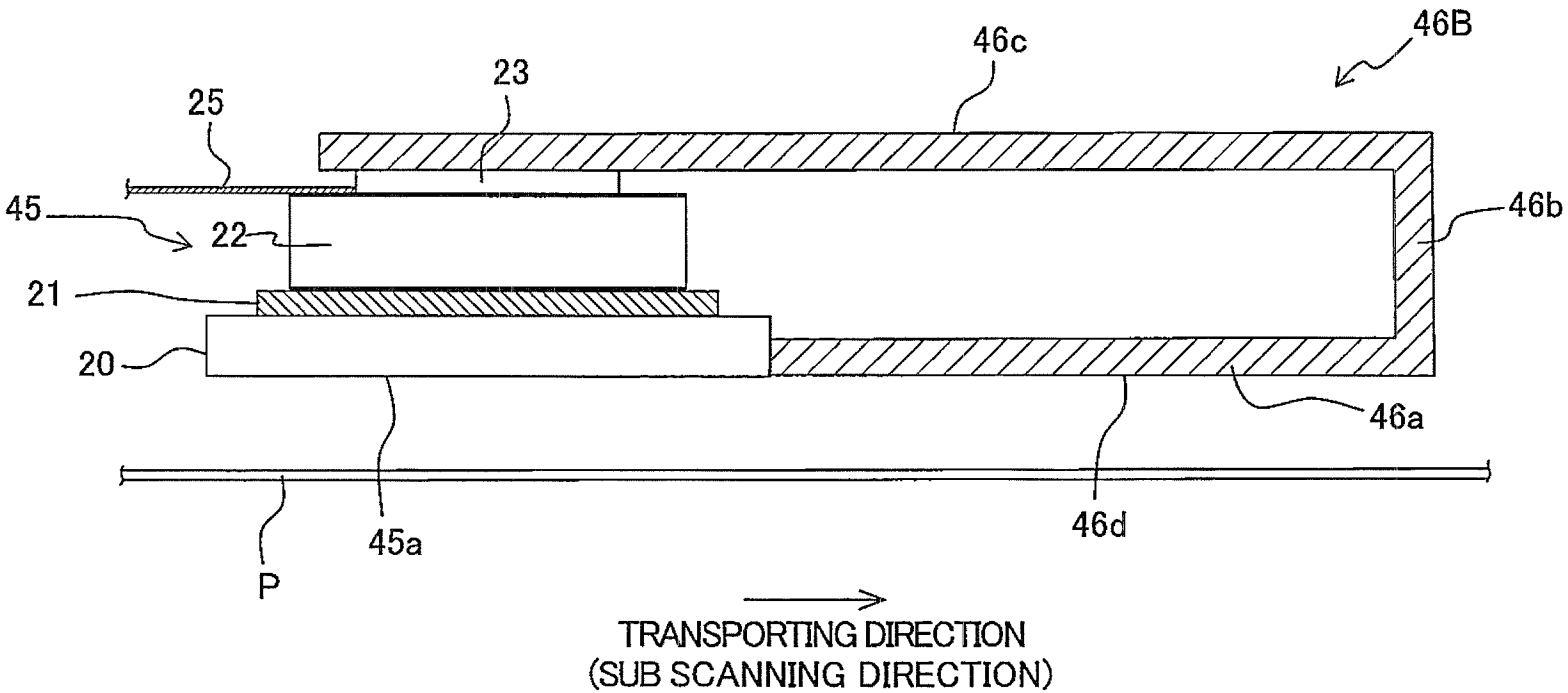
FIG. 19 is a cross-sectional view in relation to the vertical plane including the line XIX-XIX to illustrate the ink-jet head and the heat radiating member in FIG. 16.

As shown in FIG. 16, the four heat radiating members 46 are provided with respect to the four jetting units 45, respectively. As shown in FIG. 18 and FIG. 19, each of the heat radiating members 46 includes a first heat-radiating portion 46*a*, a second heat-radiating portion 46*b*, and a third heat-radiating portion 46*c*.

The first heat-radiating portion 46*a* extends in the transport direction along a liquid droplet jetting surface 45*a* of the jetting unit 45. As shown in FIG. 16 and FIG. 18, in two heat-radiating members 46A, which correspond to two jetting units 45, among the four jetting units 45, positioned at the downstream side in the transport direction, each of the first heat-radiating portions 46*a* extends in the upstream side in the transport direction from and along the liquid droplet jetting surface 45*a* of the corresponding jetting unit 45. As shown in FIG. 18, a lower surface (heat radiating surface 46*d*) of the first heat-radiating portion 46*a* of the heat-radiating member 46A projects downward as compared with a plane including the liquid droplet jetting surface 45*a*. On the other hand, as shown in FIG. 16 and FIG. 19, in two heat-radiating members 46R corresponding to two jetting units 45 positioned at the upstream side in the transport direction, each of the first heat-radiating portions 46*a* extends in the downstream side in the transport direction from and along the liquid droplet jetting surface 45*a* of the corresponding jetting unit 45. As shown in FIG. 19, a lower surface (heat radiating surface 46*d*) of the first heat-radiating portion 46*a* of the heat radiating member 46B is positioned on the plane including the liquid droplet jetting surface 45*a*.

As described above, since the heat radiating surface 46*d* of the heat radiating member 46 is positioned on the plane including the liquid droplet jetting surface 45*a* or projects downward as compared with the plane including the liquid droplet jetting surface 45*a*, the strong air flow, which is generated in the gap between the liquid droplet jetting surface 45*a* and the recording paper sheet P at the time of transporting the recording paper sheet P, is allowed to flow along the heat radiating surface 46*d*. Therefore, the heat radiation from the heat radiating surface 46*d* of the first heat-radiating portion 46*a* is promoted to enhance the heat-radiation efficiency of the heat radiating member 46.

As shown in FIG. 17, (the heat radiating surfaces 46*d* corresponding to the lower surfaces of) the first heat-radiating portions 46*a* of the four heat radiating members 46 are arranged alternately in the secondary scanning direction to be alternated with the four jetting units 45 depending on the arrangement in the zigzag form of the four jetting units 45. In a case that the four jetting units 45 are disposed in the zigzag form, an area in which the liquid droplet jetting surface 45*a* of the jetting unit 45 is not arranged, which is a so-called vacant space, is caused. However, as described above, by arranging each of the four jetting units 45 alternately with one of the heat radiating surfaces of the four heat radiating members 46, each of the first heat-radiating portions 46*a* (each of the heat radiating surfaces 46*d*) is disposed at one of the vacant areas and thereby utilizing the vacant areas effectively. Therefore, the heat radiation from each heat radiating member 46 is promoted without increasing the size of the ink-jet head 44.

As described above, as shown in FIG. 18, the heat radiating surface 46*d* of the first heat radiating portion 46*a* of each of the two heat-radiating members 46A which is positioned at the upstream side of the liquid droplet jetting surface 45*a* of the corresponding jetting unit 45 in the transport direction projects toward the recording paper sheet P as compared with the liquid droplet jetting surface 45*a*. Therefore, each of the two projecting heat radiating surfaces 46*d* prevents the recording paper sheet P transported from the upstream side in the transport direction with respect to the ink-jet head 44 from being brought in contact with the liquid droplet jetting surface 45*a*. On the other hand, as shown in FIG. 19, the heat radiating surface 46*d* of the first heat radiating portion 46*a* of each of the two heat-radiating members 46B which is positioned at the downstream side of the liquid droplet jetting surface 45*a* of the corresponding jetting unit 45 in the transport direction is positioned on the plane including the liquid droplet jetting surface 45*a*. Therefore, it is possible to prevent the recording paper sheet P which has passed under the liquid droplet jetting surface 45*a* from being caught with respect to the heat radiating surface 46*d* disposed rearward.

The second heat radiating portion 46*b* extends upward from the end portion of the first heat radiating portion 46*a* disposed on the side opposite to the liquid droplet jetting surface 45*a*. The third heat radiating portion 46*c* extends in the transport direction from the upper end portion of the second heat radiating portion 46*b* to arrive at the position above the ink-jet head 44 parallel to the first heat radiating portion 46*a*, and further the third heat radiating portion 46*c* makes contact with the two driver ICs 23. Accordingly, the heat generated in the driver ICs 23 is conducted to the heat radiating member 46 at the third heat radiating portion 46*c* and then is radiated from the first heat radiating portion 46*a*, the second heat radiating portion 46*b*, and the third heat radiating portion 46*c*.

As shown in FIG. 16, in the two heat radiating members 46A of the four heat radiating members 46, each of the second heat radiating portions 46*b* is positioned at the upstream side of each of the liquid droplet jetting surfaces 45*a* in the transport direction. Thus, the strong air flow generated when the recording paper sheet P is transported with respect to the ink-jet head 44 hits each of the second heat radiating portions 46*h*. Therefore, the heat radiation is particularly facilitated from the second heat radiating portions 46*b* in the two heat radiating members 46A.

Next, modified embodiments in which various modifications are made in the second embodiment will be described below. The same reference numerals are assigned to components each having the same structure as the second embodiment, and the description of such components is appropriately omitted.

[First Modified Embodiment]

Figure 20:
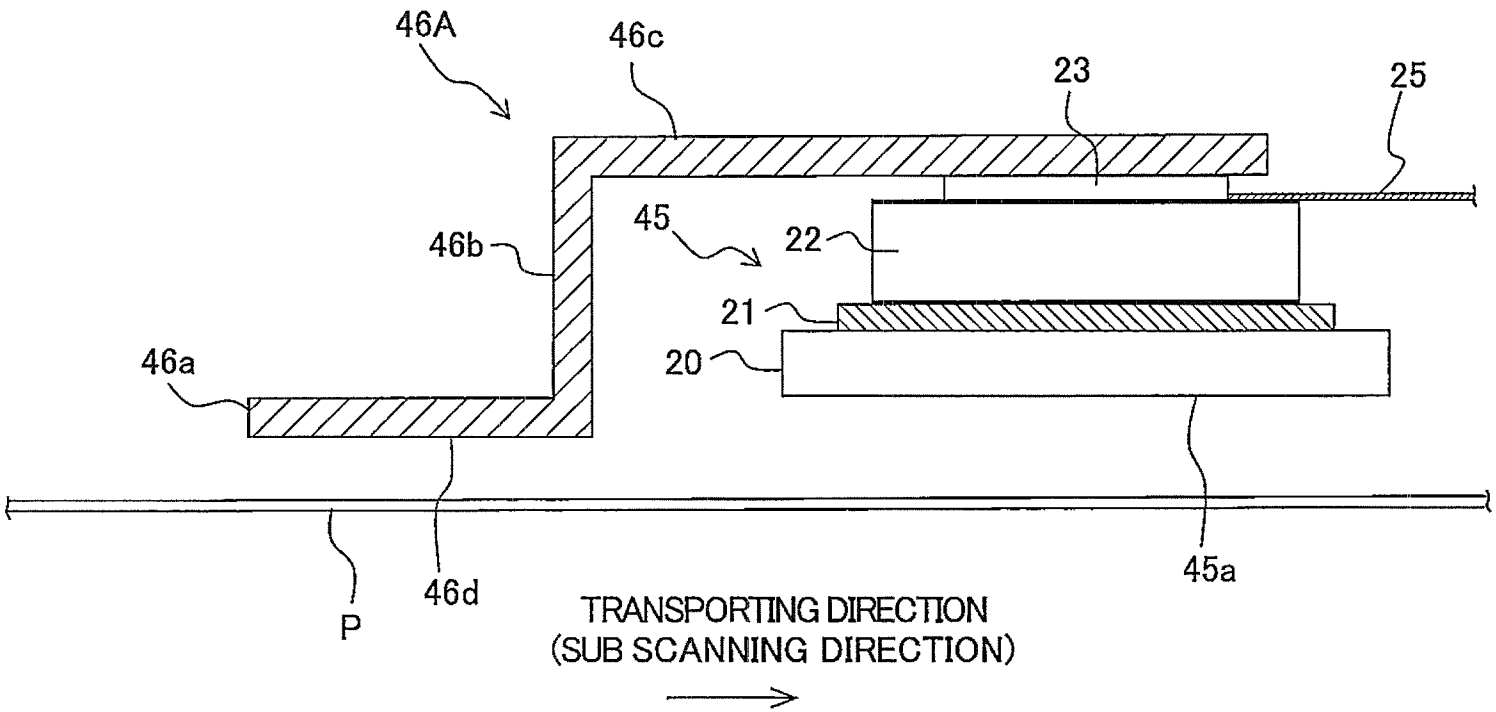
FIG. 20 is a vertical cross-sectional view of the ink-jet head and the heat radiating member in the first modified embodiment of the second embodiment.

The first heat radiating portion 46*a* of the heat radiating member 46 may extend toward the side opposite to the corresponding liquid droplet jetting surface 45*a* with respect to the second heat radiating portion 46*b*. In particular, as shown in FIG. 20, the first heat radiating portion 46*a* positioned at the upstream side of the corresponding liquid droplet jetting surface 45*a* in the transport direction preferably extends toward the side opposite to the liquid droplet jetting surface 45*a* (that is, upstream side in the transport direction). In this case, it is possible to reliably press the transported recording paper sheet P by the first heat radiating portion 46*a*, and thereby making it possible to prevent jam of the recording paper sheet P while suppressing the warpage etc., of the recording paper sheet P.

[Second Modified Embodiment]

Figure 21:
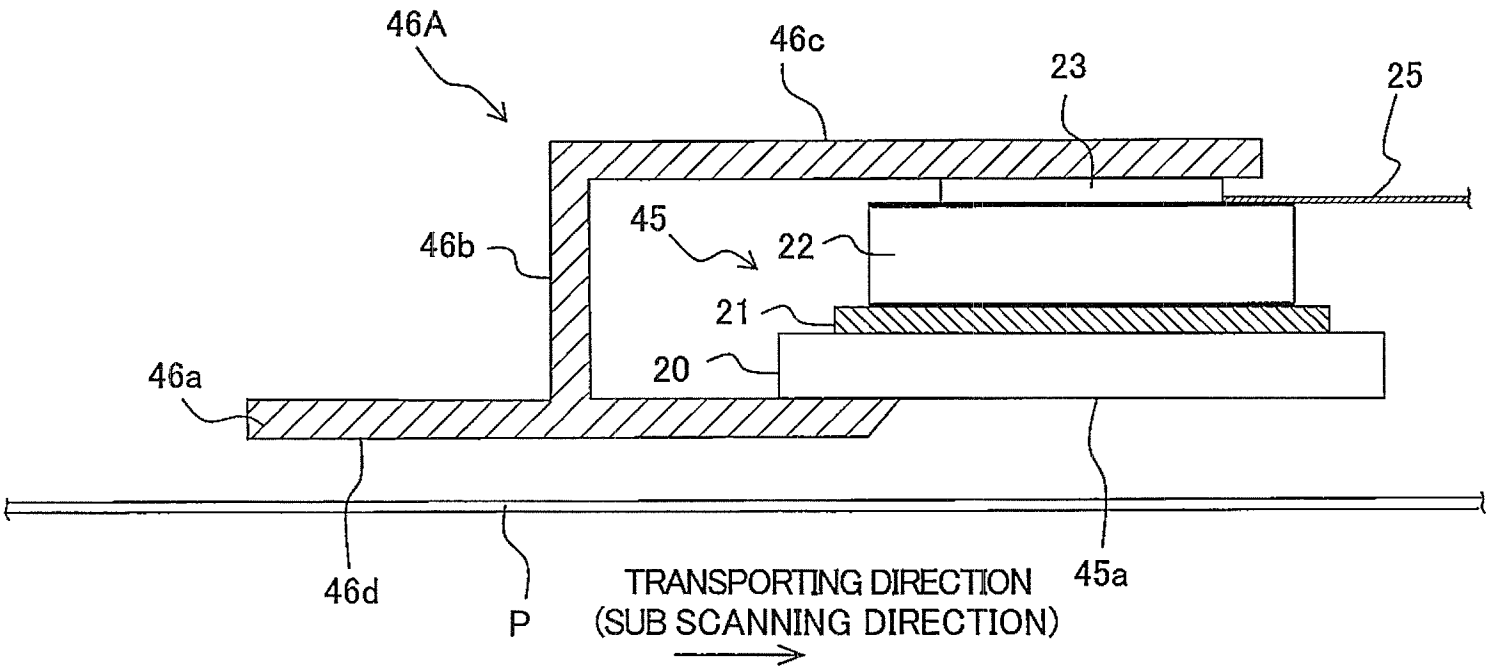
FIG. 21 is a vertical cross-sectional view of the ink-jet head and the heat radiating member in the second modified embodiment of the second embodiment.

As shown in FIG. 21, the first heat radiating portion 46*a* of the heat radiating member 46 may extend toward the corresponding liquid droplet jetting surface 45*a* and the side opposite to the corresponding liquid droplet jetting surface 45*a*, respectively, with respect to the second heat radiating portion 46*b*.

[Third Modified Embodiment]

Figure 22:
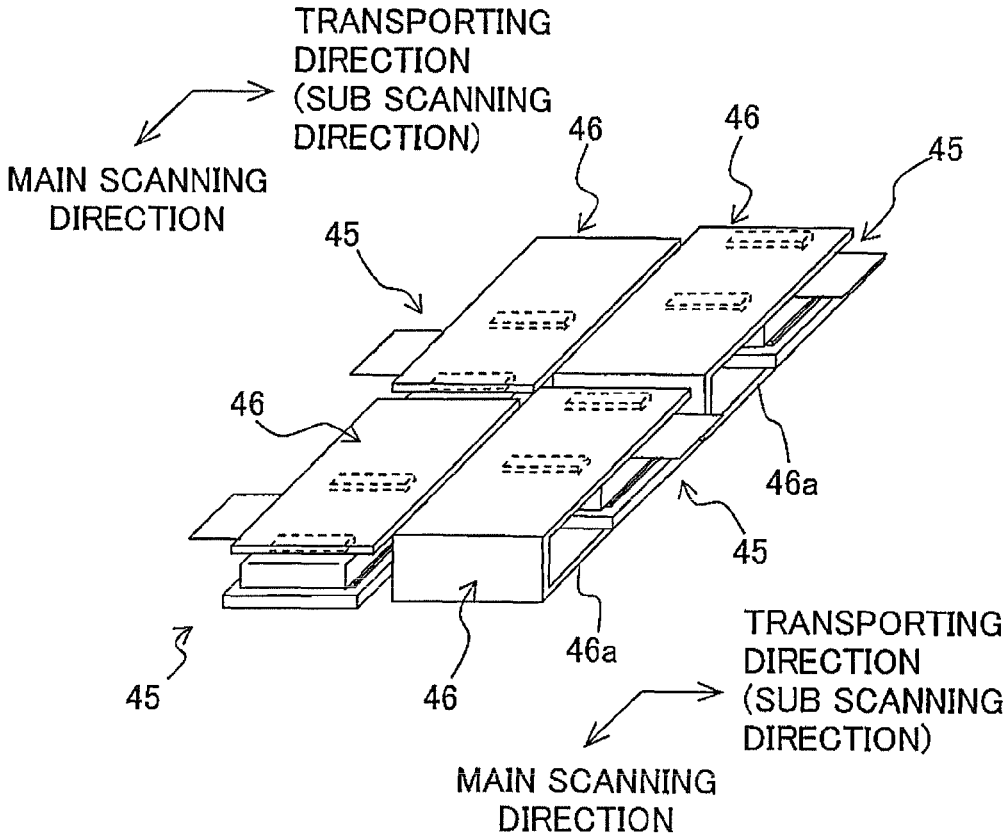
FIG. 22 is a perspective view of the ink-jet head and the heat radiating member in the third modified embodiment of the second embodiment.

In the second embodiment, although the first heat radiating portion 46*a* of each of the heat radiating members 46 extends in the transport direction from the liquid droplet jetting surface 45*a* of the corresponding jetting unit 45 (see FIG. 16), each of the first heat radiating portions 46*a* may extend in the main scanning direction from the liquid droplet jetting surface 45*a* of the corresponding jetting unit 45 as shown in FIG. 22.

[Fourth Modified Embodiment]

Figure 23:
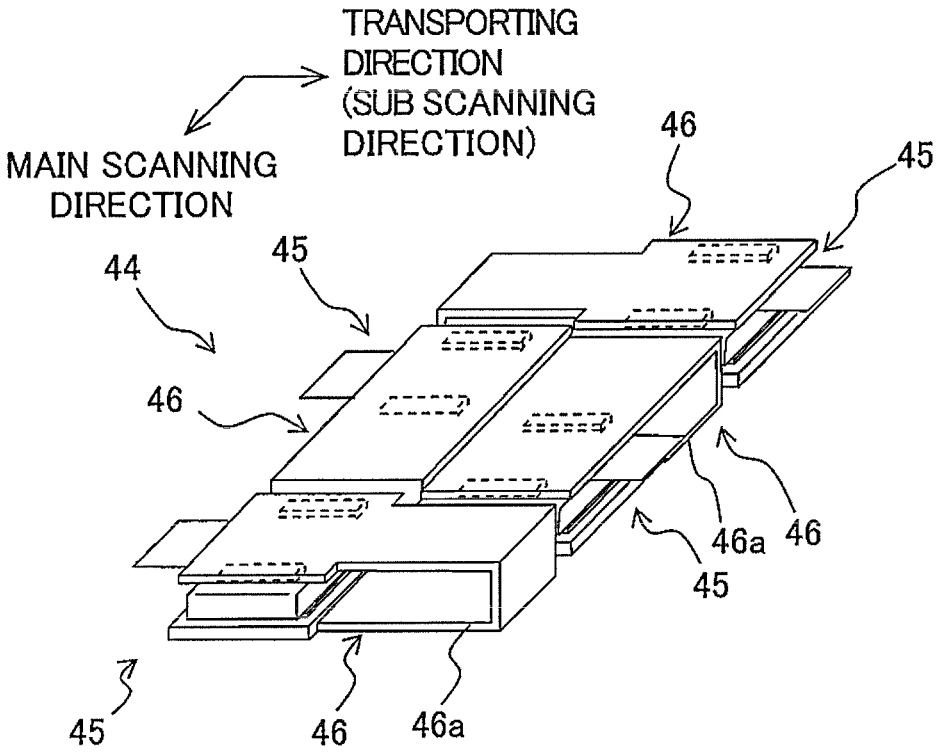
FIG. 23 is a perspective view of the ink-jet head and the heal radiating member in the fourth modified embodiment of the second embodiment.

It is not indispensable that all of the first heat radiating portions 46*a* of the four heat radiating members 46 extend in the same direction (main scanning direction or transport direction). For example, as shown in FIG. 23, in the two heat radiating members 46, among the four heat radiating members 46, which are arranged on outer sides in the main scanning direction, each of the first heat radiating portions 46*a* extends in the transport direction from the liquid droplet jetting surface 45*a* of the corresponding jetting unit 45. In the remaining two heat radiating members 46, each of the first heat radiating portions 46*a* may extend in the main scanning direction from the liquid droplet jetting surface 45*a* of the corresponding jetting unit 45.

[Fifth Modified Embodiment]

In the second embodiment, the heat radiating surface 46*d* of the heat radiating member 46A positioned at the upstream side of the liquid droplet jetting surface 45*a* in the transport direction projects downward as compared with the liquid droplet jetting surface 45*a* (see FIG. 18), and thereby making it possible to obtain the effect that the recording paper sheet P is less likely to contact with the liquid droplet jetting surface 45*a*. Here, the effect to prevent the recording paper sheet P from being brought in contact with the liquid droplet jetting surface 45*a* is greater, as the number of heat radiating surfaces 46*d*, each of which projects downward as compared with the corresponding liquid droplet jetting surface 45*a*, is greater. Therefore, the number of heat radiating surfaces 46*d*, each of which is positioned at the upstream side of the corresponding liquid droplet jetting surface 45*a* in the transport direction, is preferably greater than the number of heat radiating surfaces 46*d*, each of which is positioned at the downstream side of the corresponding liquid droplet jetting surface 45*a* in the transport direction.

Figure 24:
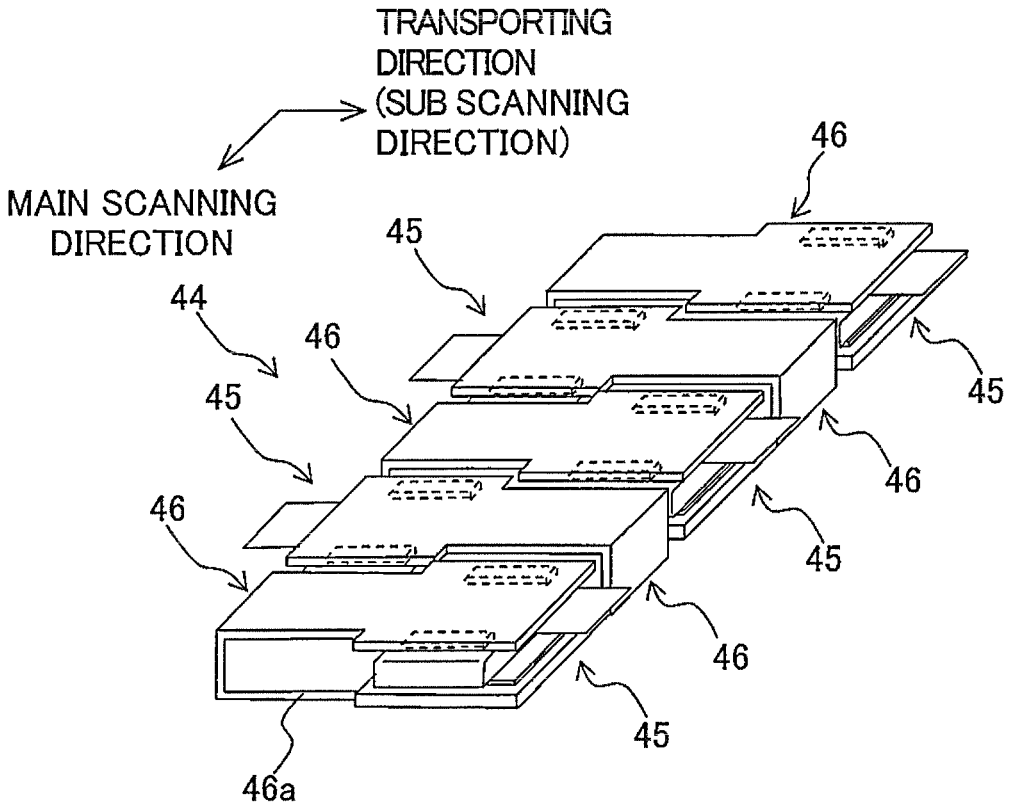
FIG. 24 is a perspective view of the ink-jet head and the heat radiating member in the fifth modified embodiment of the second embodiment.

FIG. 24 shows a specific example of the structure as described above. As shown in FIG. 24, in a case that the ink-jet head 44 has odd numbers of jetting units 45 (five jetting units 45 in FIG. 24) and that the odd numbers of jetting units 45 are arranged in the zigzag form, the number of jetting units 45 positioned at the upstream side in the transport direction is different from the number of jetting units 45 positioned at the downstream side. Here, as shown in FIG. 24, the number of jetting units 45 positioned at the upstream side in the transport direction is made to be smaller than the number of jetting units 45 positioned at the downstream side in the transport direction. Then, the number of first heat radiating portions 46*a*, of the odd numbers of the first heat radiating portions 46*a* arranged alternately with the odd numbers of jetting units 45, each of which is positioned at the upstream side of the liquid droplet jetting surface 45*a* of each of the jetting, units 25 in the transport direction is greater than the number of first heat radiating portions 46*a*, each of which is positioned at the downstream side of the liquid droplet jetting surface 45*a* of each of the jetting units 25. Accordingly, the number of heat radiating surfaces 46*d* of the first heat radiating portions 46*a*, each of which is positioned at the upstream side of the liquid droplet jetting surface 45*a* of each of the jetting units 25 in the transport direction can be greater than the number of heat radiating surfaces 46*d*, each of which is positioned at the downstream side of the liquid droplet jetting surface 45*a* of each of the jetting units 25 in the transport direction.

[Sixth Modified Embodiment]

Figure 25:
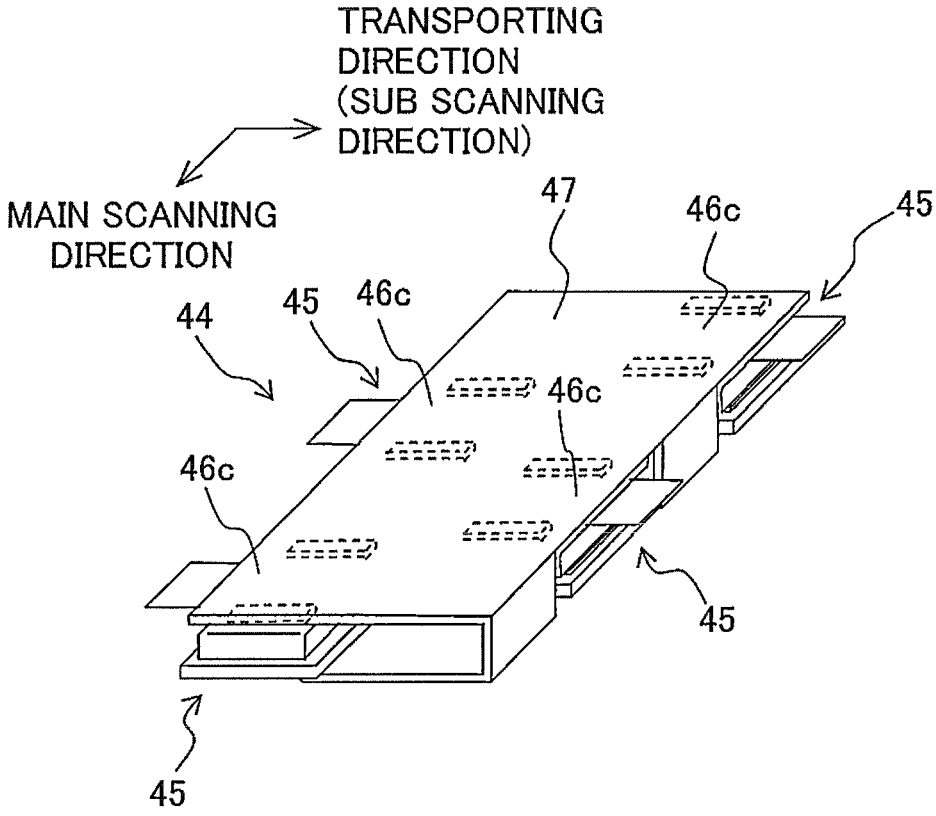
FIG. 25 is a perspective view of the ink-jet head and the heat radiating member in the sixth modified embodiment of the second embodiment.

The heat radiating members 46 provided correspond to the jetting units 45 respectively may be united or integrated by connecting them to one another. For example, in FIG. 25, by forming the third heat radiating portions 46*c* contacting with the driver ICs 23 of the four jetting units 45 by using one plate portion 47, the four heat radiating members 46 are connected to one another to be united or integrated. By connecting the plurality of heat radiating members 46 as described above, it is prevented that the heat is remained unequally and locally at a part of the heat radiating members 46.

[Seventh Modified Embodiment]

Figure 26:
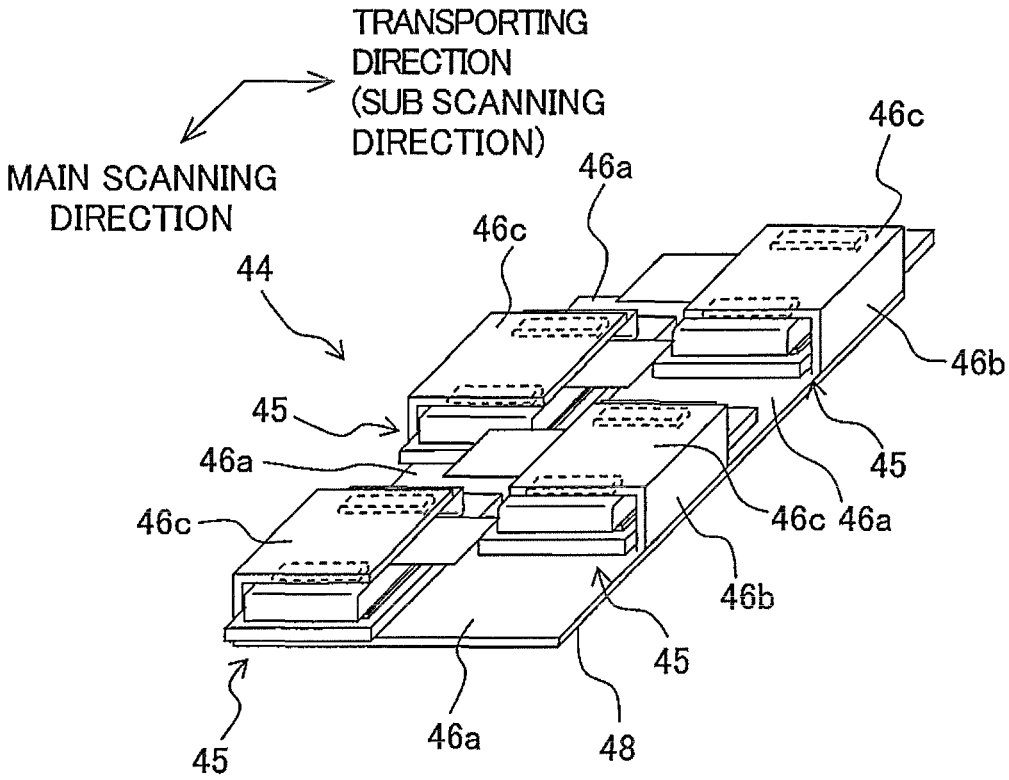
FIG. 26 is a perspective view of the ink-jet head and the heat radiating member in the seventh modified embodiment of the second embodiment.
Figure 27:
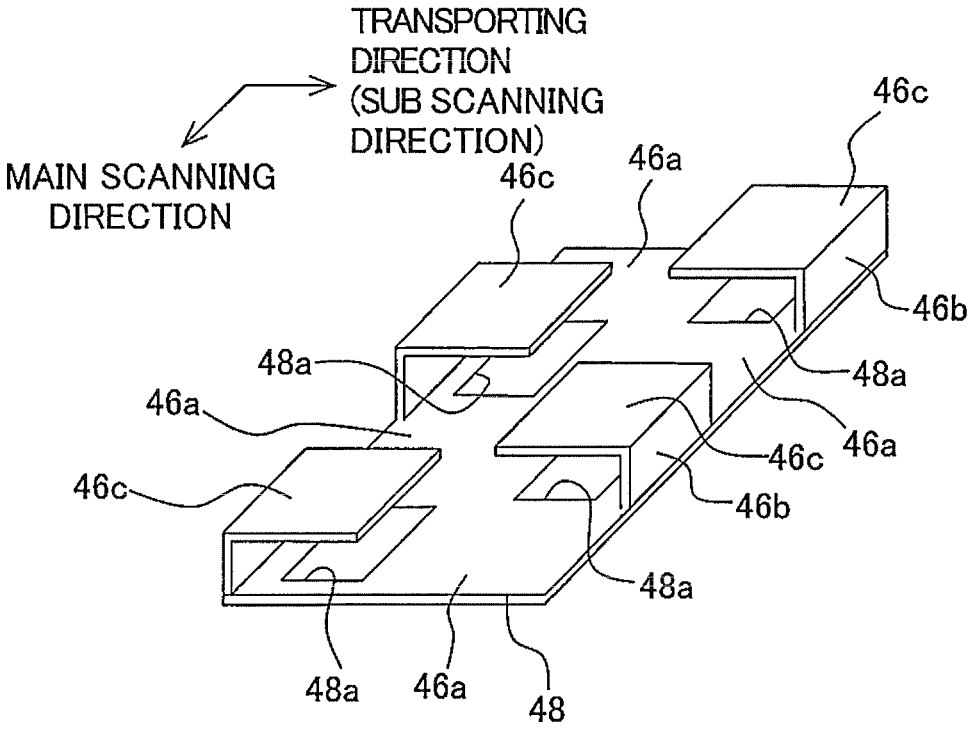
FIG. 27 is a perspective view of the heat radiating member in the seventh modified embodiment.

As shown in FIG. 26, the first heat radiating portions 46*a* of the four heat radiating members 46 may be formed of one plate portion 48 to be connected to one another. FIG. 27 is a perspective view of the heat radiating members. In the seventh modified embodiment, as shown in FIG. 27, four openings 48*a* are formed in the plate portion 48 to expose the liquid droplet jetting surfaces 45*a* of the four jetting units 45 respectively.

Other than the above, also in the second embodiment, the shape and the like of the heat radiating member 46 can be changed in a similar manner to the first embodiment, such as the structure in which the driver ICs 23 make contact with the second heat radiating portion 46*b* and the structure in which the second heat radiating portion 46*b* or the third heat radiating portion 46*c* is omitted.

[Eighth Modified Embodiment]

The heat radiating surface 46*d* of each of the heat radiating members 46 disposed alternately with each of the jetting units 45 is adjacent to the liquid droplet jetting surface 45*a* of each of the jetting units 45 in the main scanning direction and the secondary scanning direction. Then, in a case that a pressing mechanism, which presses the recording paper sheet P to prevent floating-up, warpage, and the like of the recording paper sheet P, is provided in each of the heat radiating surfaces 46*d*, it is possible to press the recording paper sheet P near each of the liquid droplet jetting surfaces 45*a*, and it is possible to effectively suppress position deviation of landing of the liquid droplets, which would be otherwise caused by the floating-up and the like of the recording paper sheet P.

Figure 28:
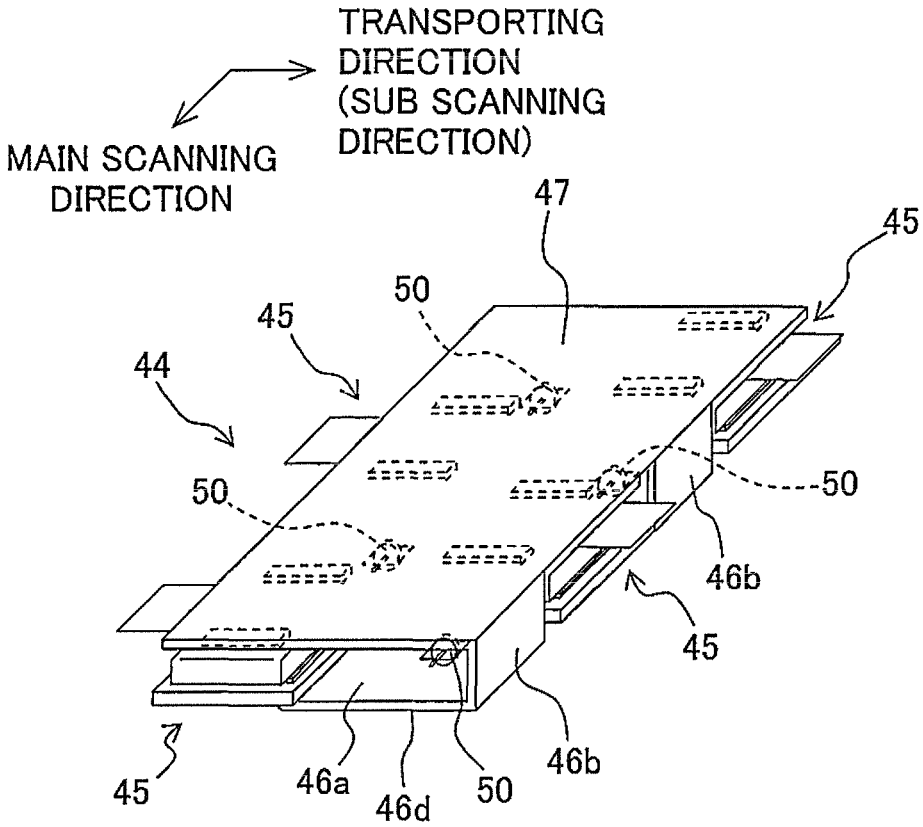
FIG. 28 is a perspective view of the ink-jet head and the heat radiating member in the eighth modified embodiment of the second embodiment.

In FIG. 28, spur rollers 50 (pressing members) are rotatably attached to the first heat radiating portions 46*a* of the heat radiating members 46, and the spur rollers 50 project downward as compared with the lower surfaces (heat radiating surfaces 46*d*) of the first heat radiating portions 46*a*. Thus, in a case that the recording paper sheet P is transported in the transport direction with respect to the ink-jet head 44, the spur rollers 50 make contact directly with the recording paper sheet P to prevent the floating-up, the warpage, and the like of the recording paper sheet P. Further, in a case that the heat radiating members 46 are formed of a conductive material such as the metallic material, it is preferable that the spur rollers 50 are also formed of the conductive material such as the metallic material. In this construction, electronic charge charged on the recoding paper sheet P is allowed to flow from the spur rollers 50 to the heat radiating members 46, and thereby removing the electric charge charged on the recording paper sheet P. Accordingly, it is possible to prevent, as much as possible, the bending of the landing of the liquid droplets, and the like, due to the electronic charge of the recording paper sheet P.

The pressing mechanism provided in each of the heat radiating surfaces 24*d* is not limited to those which make contact directly with the recording paper sheet P like the spur rollers 50 as described above. For example, the pressing mechanism may be a pressing mechanism which includes air nozzles and presses the recording paper sheet P against the platen 2 by jetting air to the recording paper sheet P from the air nozzles, and thereby preventing the floating-up and the like of the recording paper sheet P.

[Ninth Modified Embodiment]

Figure 29:
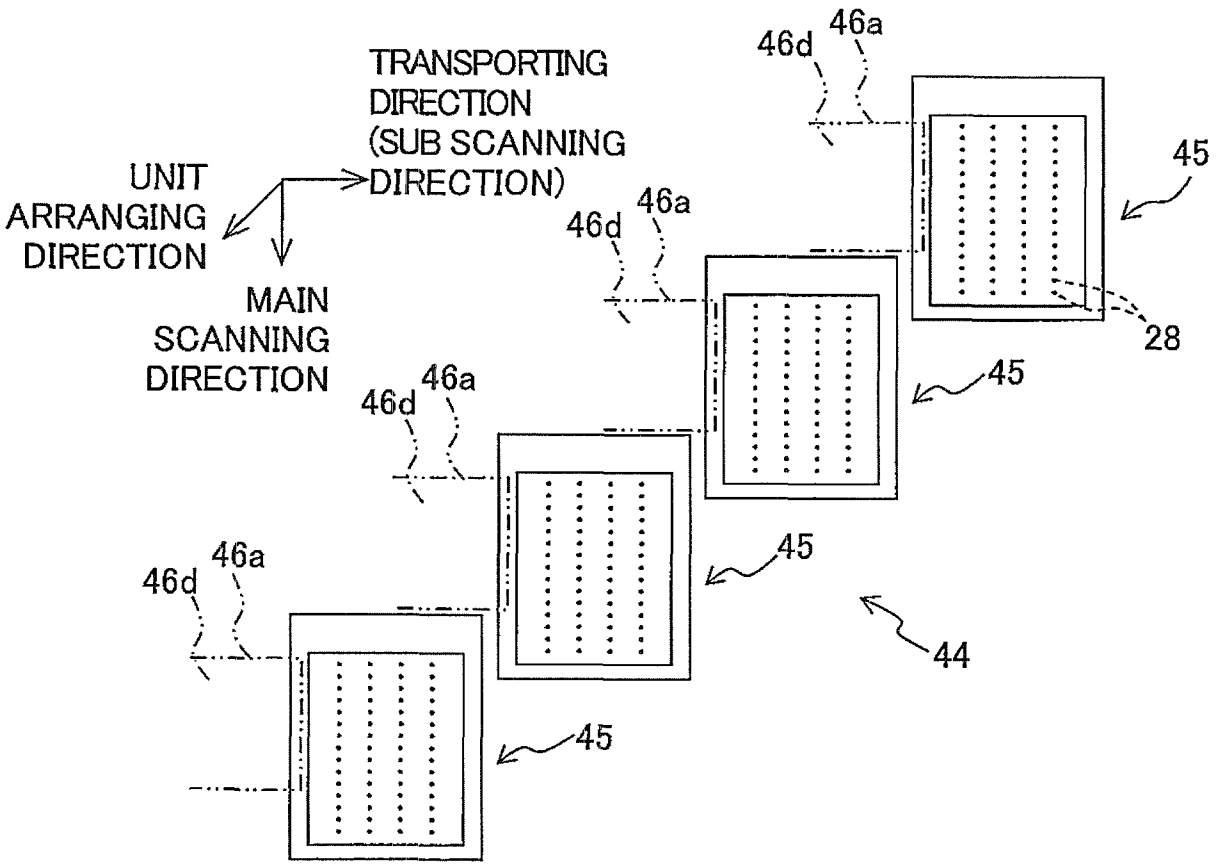
FIG. 29 is a diagram showing a planar arrangement relationship of four jetting units of the ink-jet head in the ninth modified embodiment.

It is not indispensable that the plurality of jetting units 45 are arranged in the zigzag form. For example, as shown in FIG. 29, the four jetting units 45 may be disposed in a predetermined unit arrangement direction in which the four jetting units 45 intersect in the main scanning direction and the transport direction respectively. In FIG. 29, although the heat radiating surface 46*d* of the heat radiating member 46 corresponding to each of the jetting units 45 is positioned at the upstream side of the liquid droplet jetting surface 45*a* of each of the jetting units 45 in the transport direction, the heat radiating surface 46*d* of the heat radiating member 46 may be partially or entirely positioned at the downstream side of the liquid droplet jetting surface 45*a* of the corresponding jetting unit 45 in the transport direction. However, as shown in FIG. 18, in a case that the construction in which the heat radiating surface 46*d* positioned at the upstream side in the transport direction projects downward as compared with the liquid droplet jetting surface 45*a* is adopted, the number of heat radiating surfaces 46*d*, each of which is positioned at the upstream side of the corresponding liquid droplet jetting surface 45*a* in the transport direction, is preferably greater than the number of heat radiating surfaces 46*d*, each of which is positioned at the downstream side of the corresponding liquid droplet jetting surface 45*a* in the transport direction.

Tenth Modified Embodiment

Figure 30:
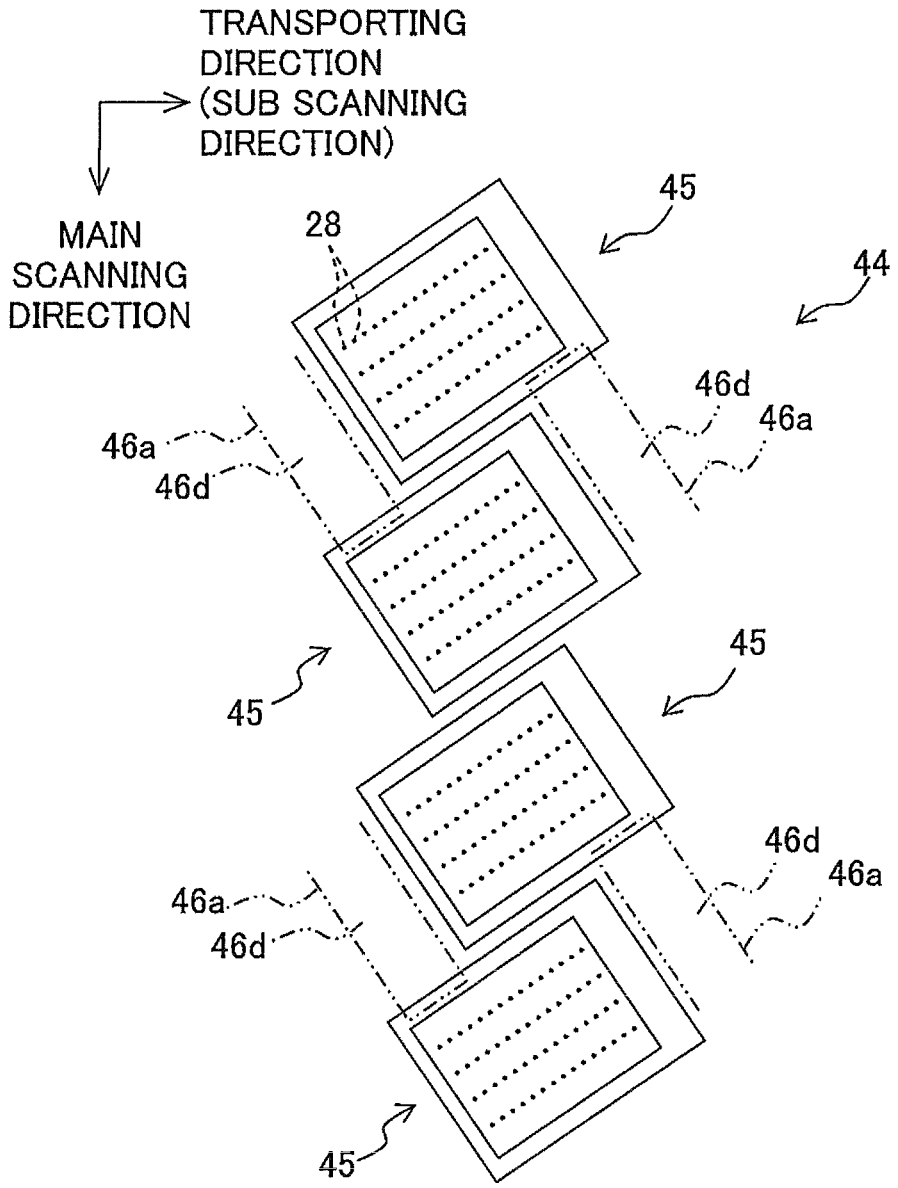
FIG. 30 is a diagram showing a planar arrangement relationship of four jetting units of the ink-jet head in the tenth modified embodiment.

As shown in FIG. 30, the plurality of nozzles 28 of each of the jetting units 45 may be disposed in a direction in which the nozzles 28 intersect at a predetermined angle with respect to the main scanning direction instead of being arranged in the main scanning direction.

[Eleventh Modified Embodiment]

Figure 31:
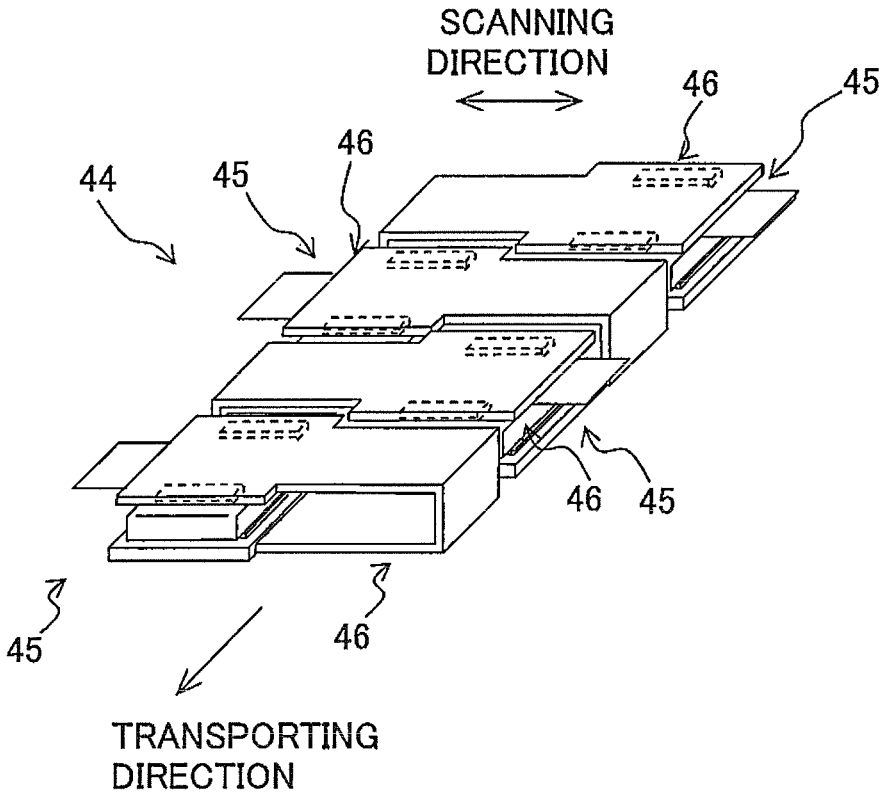
FIG. 31 is a perspective view of the ink-jet head and the heat radiating member in the eleventh modified embodiment of the second embodiment.

The ink-jet head 44 provided with the plurality of jetting units 45 can be adopted to the serial-type ink-jet printer as shown in FIG. 1. For example, the image and the like can be recorded on the recording paper sheet P as follows. That is, as shown in FIG. 31, an arrangement direction of the nozzles in each of the jetting units 45 is made to be the transport direction of the recording paper sheet P and the ink-jet head 44 is reciprocatingly moved in the scanning direction perpendicular to the transport direction.

Twelfth Modified Embodiment

It is not indispensable that the line-type ink-jet head as shown in FIG. 15 is an ink-jet head formed of the plurality of jetting units 45 as shown in FIG. 16. For example, the line-type ink-jet head as shown in FIG. 15 may be an ink-jet head provided with one channel unit including a plurality of nozzles aligned over the entire width of the recording paper sheet P (entire area in the main scanning direction).

[Modifications Applicable Commonly to the First Embodiment and Second Embodiment]

In the first embodiment and the second embodiment (and the modified embodiments thereof), a mechanism (energy applying mechanism) which jets liquid droplets of the ink from the nozzles 28 is exemplified by the piezoelectric actuator 21. However, the energy applying mechanism is not limited to the piezoelectric actuator. In other words, the present invention is applicable irrespective of a form of the energy applying mechanism provided that the heat is generated in the driver ICs 23 driving the energy applying mechanism. For example, in the above explanation, the present invention is applied to the ink-jet printer in which the ink is discharged by using the pressure generated when the pressure chamber is deformed by the piezoelectric actuator. In addition, the present invention is also applicable to an ink-jet printer in which the ink is discharged by using the pressure generated when the ink is heated.

In the first embodiment and the second embodiment, the present invention is applied to the ink-jet printer which records the image on the recording paper sheet. However, the present invention can be also applied to a liquid droplet jetting apparatus used in various uses other than recording of the image etc. For example, the present invention can be also applied to a liquid droplet jetting apparatus which jets a conductive liquid on a board as an object to be jetted to form a conductive pattern on the surface of the board.

Figure 32:
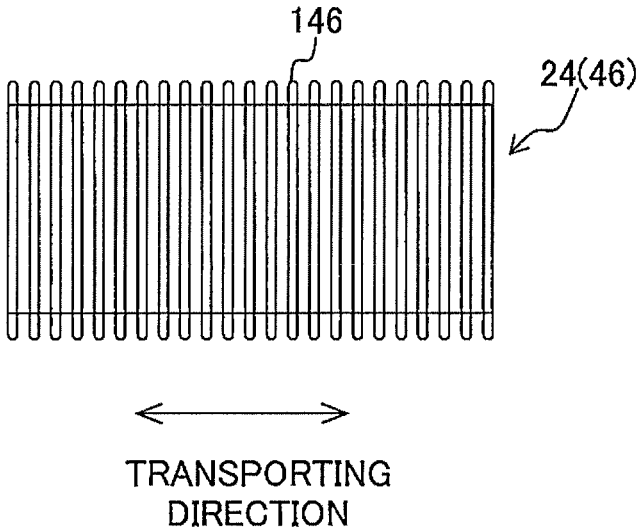
FIG. 32 is a side view of the heat radiating member having a plurality of fins.

Although the heat radiating surface of the heat radiating member 46 is a flat surface in the first and second embodiments and the modified embodiments thereof the present invention is not limited thereto. For example, as shown in FIG. 32, a plurality of heat radiating fins 146 may be formed in the heat radiating surface of the heat radiating member 46. In a case that the heat radiating fins 146 are formed in the heat radiating surface of the heat radiating member 46, a surface area of the heat radiating surface can be increased. In other words, since a contact area in which the heat radiating member 46 makes contact with ambient air can be increased, it is possible to enhance heat-radiation efficiency of the heat radiating member 46. Here, an extending direction of each of the heat radiating fins 146 preferably extends in a relative-movement direction of the ink-jet head with respect to the recording paper sheet. For example, in a case that the ink-jet head is configured to move in a predetermined scanning direction, like the ink-jet head 4 as described above, the extending direction of each of the heat radiating fins 146 is preferably the scanning direction in a plane parallel to the lower surface of the ink-jet head. In this case, the air flow generated in connection with the movement of the ink-jet head passes through a gap between the heat radiating fins 146 efficiently, and thereby making it possible to improve the heat-radiation efficiency of the heat radiating member 46. The shape of the heat radiating surface is not necessarily required to be a fin shape, and may be any shape such as a concave-convex shape and a groove shape, provided that the surface area of the heat radiating surface can be increased.

Figure 33:
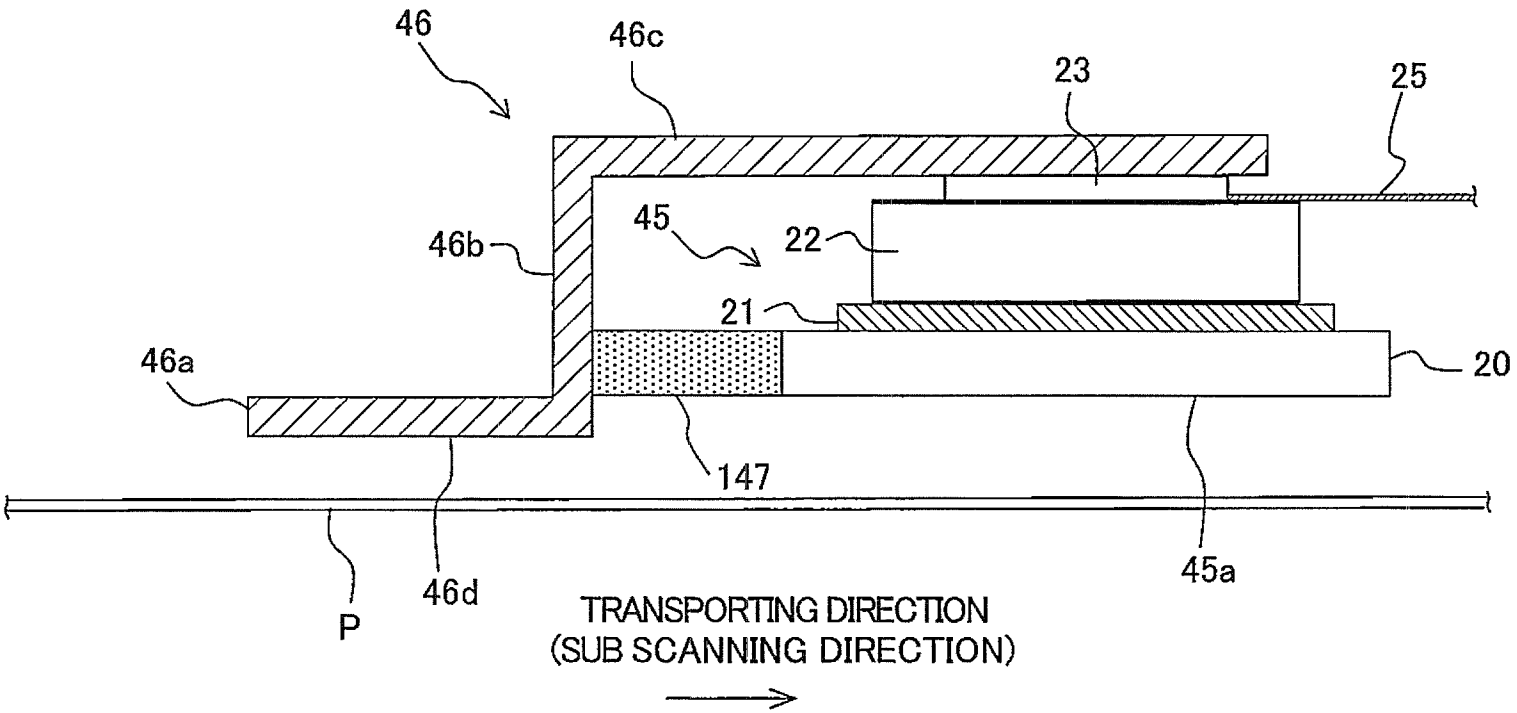
FIG. 33 is a perspective view of the ink-jet head and the heat radiating member having a seal material sealing a gap between the ink-jet head and the heat radiating member.

In the first and second embodiments and the modified embodiments thereof, the explanations are made by exemplifying the heat radiating member 46 formed of the metallic material. The present invention, however, is not limited thereto. In the present invention, any material can be used provided that thermal conductivity thereof is high. For example, the heat radiating member 46 may be formed of a resin material having the high thermal conductivity. Further, as shown in FIG. 33 for example, in a case that a gap is formed between the channel unit 20 of the ink-jet head 4 and heat radiating member 46 (24), a seal material 147 may be filled in the gap for sealing the gap. In this case, since the seal material 147 seals the gap, ink mist generated by the jetted ink jetted from the ink-jet head 4 can not enter into the gap. Therefore, it is possible to inhibit the ink-mist from adhering to the actuator 20 etc. In order to release the heat from the heat radiating member 46 (24) efficiently, it is desirable that the seal material 147 is formed from a material having high thermal conductivity.

The embodiments and the modified embodiments thereof described above are described merely by way of example in every sense. The present teaching is not limited to the embodiments and the modified embodiments. For example, a plurality of the modified embodiments may be carried out appropriately in combination.

What is claimed is:

1. A liquid droplet jetting apparatus which jets droplets of a liquid onto an object, comprising: a liquid droplet jetting head including; a liquid droplet jetting surface arranged on a liquid droplet jetting surface plane, formed with a plurality of nozzles from which the droplets are jetted; an energy applying mechanism configured to apply a jetting energy to the liquid in each of the nozzles; and a driving device configured to drive the energy applying mechanism; a relative movement mechanism configured to move, along the liquid droplet jetting surface, the liquid droplet jetting head relative to the object to which the droplets are jetted from the nozzles; and a heat radiating member configured to be provided in the liquid droplet letting head to radiate heat generated m the driving device; wherein the heat radiating member includes a heat radiating surface which is positioned on the liquid droplet jetting surface plane or which is positioned at a downstream side in a jetting direction in which the droplets jetted from the nozzles fly as compared with the liquid droplet jetting surface plane.

2. The liquid droplet jetting apparatus according to claim 1; wherein the heat radiating member includes a first heat radiating portion, which extends along the liquid droplet jetting surface plane, and includes the heat radiating surface configured to face the object, and a second heat radiating portion which extends, in a direction intersecting the liquid droplet jetting surface, from the first heat radiating portion toward a side opposite to the heat radiating surface.

3. The liquid droplet jetting apparatus according to claim 2;

wherein the liquid droplet jetting head is configured to jet the liquid droplets while relatively moving with respect to the object in one direction; and wherein the second heat radiating portion is positioned at an upstream side, as compared with the liquid droplet jetting surface, in the one direction which is a relative movement direction of the object with respect to the liquid droplet jetting head.

4. The liquid droplet jetting apparatus according to claim 3;

wherein the relative movement mechanism is configured to move the liquid droplet jetting head relative to the object so that the liquid droplet jetting head reciprocates in a scanning direction parallel to the liquid droplet jetting surface;

wherein the second heat radiating portion is configured as two second heat radiating portions; and wherein the two second heat radiating portions are arranged at both sides of the liquid droplet jetting surface in the scanning direction, respectively.

5. The liquid droplet jetting apparatus according to claim 2;

wherein the heat radiating member further includes a third heat radiating portion which is connected to the second heat radiating portion and is arranged in the liquid droplet jetting bead at a side opposite to the liquid droplet jetting surface.

6. The liquid droplet jetting apparatus according to claim 5;

wherein the second heat radiating portion or the third heat radiating portion of the heat radiating member makes contact with the driving device.

7. The liquid droplet jetting apparatus according to claim 1;

wherein the liquid droplet jetting head is configured to jet the liquid droplets while relatively moving with respect to the object in one direction; and wherein the heat radiating surface is disposed at an upstream side of the liquid droplet jetting surface in a relative movement direction of the object with respect to the liquid droplet jetting head; and the heat radiating surface projects in the downstream side in the jetting direction as compared with the liquid droplet jetting surface.

8. The liquid droplet jetting apparatus according to claim 1;

wherein the liquid droplet jetting head includes: a plurality of jetting units each having the liquid droplet jetting surface formed with the nozzles aligned in a first direction; the energy applying mechanism; and the driving device;

wherein the plurality of jetting units are arranged in the first direction and are arranged alternately in a second direction, which is parallel to the liquid droplet jetting surface and is perpendicular to the first direction, to form a staggered form;

wherein a plurality of heat radiating members are provided to correspond to the plurality of jetting units, respectively; and wherein the heat radiating surface of each of the heat radiating members is arranged alternately in the second direction to be alternated with each of the jetting units depending on the arrangement of the jetting units in the staggered form.

9. The liquid droplet jetting apparatus according to claim 8;

wherein the heat radiating members provided to correspond to the jetting units respectively are connected to each other.

10. The liquid droplet jetting apparatus according to claim 8;

wherein a pressing mechanism which presses the object in a direction separating away from the liquid droplet ding surface is provided in the heat radiating surface of the heat radiating member.

11. The liquid droplet jetting apparatus according to claim 10;

wherein the pressing mechanism includes a pressing member which is provided in the heat radiating surface of the heat radiating member and makes contact directly with the object; and wherein the heat radiating member and the pressing member are formed of a conductive material.

12. The liquid droplet jetting apparatus according to claim 8; wherein the relative movement mechanism is configured to move the liquid droplet jetting head or the object so that the object relatively moves toward the liquid droplet jetting head from an upstream side to a downstream side in a relative movement direction parallel to the second direction; wherein the heat radiating surface of the heat radiating surfaces of the heat radiating members, which is positioned at the upstream side of the liquid droplet jetting surface of each of the jetting units in the relative movement direction is positioned at the downstream side in the jetting direction as compared with the liquid droplet jetting surface; and wherein the heat radiating surface, of the heat radiating surfaces of the heat radiating members, which is positioned at the downstream side of the liquid droplet jetting surface of each of the jetting units in the relative movement direction is positioned on the liquid droplet jetting surface plane.

13. The liquid droplet jetting apparatus according to claim 12;

wherein the liquid droplet jetting head includes odd numbers of jetting units;

wherein the liquid droplet jetting apparatus further includes odd numbers of heat radiating members provided in the odd numbers of jetting units, respectively; and wherein the number of heat radiating surfaces, each of which is positioned at the upstream side of each of the jetting units in the relative movement direction, is greater than the number of heat radiating surfaces, each of which is positioned at the downstream side of each of the jetting units in the relative-movement direction.

14. The liquid droplet jetting apparatus according to claim 1; wherein the liquid droplet jetting head includes a plurality of jetting units each having the liquid droplet jetting surface formed with the nozzles, the energy applying mechanism, and the driving device; wherein the jetting units are arranged in a first direction; wherein the plurality of heat radiating members are provided to correspond to the plurality of jetting units, respectively; wherein the relative movement mechanism moves the liquid droplet jetting head relative to the object in a second direction which is parallel to the liquid droplet jetting surface and intersects the first direction; wherein a part of the heat radiating surfaces of the heat radiating members are each positioned at an upstream side of the liquid jetting surface of each of the jetting units in a movement direction of the object with respect to the liquid droplet jetting head and each is positioned at the downstream side in a jetting direction as compared with the liquid droplet jetting surface; wherein a remaining part of the heat radiating surfaces are each positioned at a downstream side of the liquid jetting surface of each of the jetting units in the movement direction of the object with respect to the liquid droplet jetting head and are each arranged on the liquid droplet jetting surface plane; and wherein the number of the part of the heat radiating surfaces is greater than the number of the remaining part of the beat radiating surfaces.

15. The liquid droplet jetting apparatus according to claim 1;

wherein the relative movement mechanism includes a transport mechanism configured to transport the object in a first movement direction and a carriage configured to scan the liquid droplet jetting head in a second movement direction intersecting the first movement direction and parallel to the liquid droplet jetting surface;

wherein the second heat radiating portion is configured as two second heat radiating portions; and wherein the two second heat radiating portions are arranged at both sides of the liquid droplet jetting surface in the second movement direction, respectively.

16. The liquid droplet jetting apparatus according to claim 1;

wherein the heat radiating member includes a plurality of fins formed on the heat radiating surface thereof.

17. The liquid droplet jetting apparatus according to claim 1, further includes:

a seal material located between the heat radiating member and the liquid droplet jetting head to seal therebetween.

18. The liquid droplet jetting apparatus according to claim 2;

wherein the first heat radiating portion further includes an upper surface which is positioned at an upstream side in the direction in which the droplets jetted from the nozzles fly; and wherein the upper surface of the first heat radiating portion is configured to make a contact with the liquid droplet jetting surface.

* * * * *